US012528619B2

(12) United States Patent
Yamamoto et al.

(10) Patent No.: US 12,528,619 B2
(45) Date of Patent: Jan. 20, 2026

(54) DRAWN/IRONED CAN AND COATED METAL SHEET FOR DRAWN/IRONED CANS

(71) Applicant: TOYO SEIKAN GROUP HOLDINGS, LTD., Tokyo (JP)

(72) Inventors: Hiromi Yamamoto, Yokohama (JP); Takuya Kashiwakura, Yokohama (JP); Arata Sakuragi, Yokohama (JP); Nan Zhang, Yokohama (CN)

(73) Assignee: TOYO SEIKAN GROUP HOLDINGS, LTD., Tokyo (JP)

( * ) Notice: Subject to any disclaimer, the term of this patent is extended or adjusted under 35 U.S.C. 154(b) by 507 days.

(21) Appl. No.: 17/924,777

(22) PCT Filed: May 10, 2021

(86) PCT No.: PCT/JP2021/017740

§ 371 (c)(1),
(2) Date: Nov. 11, 2022

(87) PCT Pub. No.: WO2021/230210

PCT Pub. Date: Nov. 18, 2021

(65) Prior Publication Data

US 2023/0202715 A1 Jun. 29, 2023

(30) Foreign Application Priority Data

May 12, 2020 (JP) ..... 2020-083928

(51) Int. Cl.

| | |
|---|---|
| ***B65D 25/14*** | (2006.01) |
| ***B21D 22/28*** | (2006.01) |
| ***B21D 51/26*** | (2006.01) |
| ***B65D 1/16*** | (2006.01) |
| ***B65D 25/34*** | (2006.01) |

(52) U.S. Cl.
CPC ..... *B65D 25/14* (2013.01); *B21D 22/28* (2013.01); *B21D 51/26* (2013.01); *B65D 1/165* (2013.01); *B65D 25/34* (2013.01)

(58) Field of Classification Search
CPC ..... B65D 25/14; B65D 1/165; B65D 25/34; B65D 1/28; B21D 22/28; B21D 51/26; C08G 63/183; C09D 167/00
See application file for complete search history.

(56) References Cited

U.S. PATENT DOCUMENTS

| | | | |
|---|---|---|---|
| 2018/0291232 | A1 | 10/2018 | Kashiwakura et al. |
| 2020/0062992 | A1 | 2/2020 | Kashiwakura et al. |

FOREIGN PATENT DOCUMENTS

| | | | |
|---|---|---|---|
| JP | 2001-353812 | A | 12/2001 |
| JP | 2002-307604 | A | 10/2002 |
| JP | 2003-1759 | A | 1/2003 |
| JP | 2003-034322 | A | 2/2003 |
| JP | 2004-148324 | A | 5/2004 |
| JP | 3872998 | B2 | 1/2007 |
| JP | 2007-045115 | A | 2/2007 |
| JP | 2015-089643 | A | 5/2015 |
| JP | 2019-131275 | A | 8/2019 |
| JP | 2019-155352 | A | 9/2019 |
| WO | 2016/186138 | A1 | 11/2016 |

OTHER PUBLICATIONS

English machine translation of JP2003-034322. (Year: 2003).*
International Search Report of PCT/JP2021/017740 dated Aug. 10, 2021 [PCT/ISA/210].
Office Action issued Mar. 20, 2025 in Chinese Patent Application No. 202180033815.8.

* cited by examiner

*Primary Examiner* — Michael C Miggins
(74) *Attorney, Agent, or Firm* — Sughrue Mion, PLLC

(57) ABSTRACT

The disclosure relates to a drawn/ironed can having at least an inner surface coating film on a can inner surface side, the inner surface coating film containing a polyester resin and a curing agent, and a stress relaxation ratio of the inner surface coating film after 10 minutes at 1% elongation in a can bottom portion is 50% or higher under a test condition of 100° C., whereby metal exposure due to severe processing such as drawing or ironing and coating film peeling due to heat treatment after molding are effectively prevented.

17 Claims, No Drawings

DRAWN/IRONED CAN AND COATED METAL SHEET FOR DRAWN/IRONED CANS

CROSS REFERENCE TO RELATED APPLICATIONS

This application is a National Stage of International Application No. PCT/JP2021/017740, filed May 10, 2021, claiming priority to Japanese Patent Application No. 2020-083928, filed Mar. 12, 2020.

TECHNICAL FIELD

The disclosure relates to a drawn and ironed can (drawn/ironed can) can including a coated metal sheet and a coated metal sheet for a drawn/ironed can, and more particularly to a drawn/ironed can in which metal exposure due to severe processing such as drawing and ironing and coating film peeling due to heat treatment after molding are effectively prevented, and a coated metal sheet for a drawn/ironed can, with which such a drawn/ironed can be molded with good productivity.

BACKGROUND

An organic resin-coated metal sheet obtained by coating a metal sheet such as aluminum with a thermoplastic resin film has long been known as a material for cans. It has also been well known to subject the organic resin-coated metal sheet to drawing, drawing and ironing, or the like to make a seamless can that is filled with beverages or the like, or press-mold the sheet to make a can lid such as an easy-open end. For example, an organic resin-coated metal sheet that includes, as an organic resin coating layer, a thermoplastic resin film made of a crystalline polyester resin mainly including ethylene terephthalate units is used as a can material for a seamless can (drawn/ironed can) molded by drawing and ironing (JP 2001-353812 A, etc.). Such an organic resin-coated metal sheet can be subjected to drawing and ironing molding under a dry condition without using coolant (cooing and lubricating agent), and thus there is an environmental advantage as compared to a case where coolant is used to subject a metal sheet to drawing and ironing molding in the related art.

Such an organic resin-coated metal sheet is produced by a method in which a pre-formed film of thermoplastic polyester resin or the like is attached to a metal sheet by thermal adhesion, or a film lamination method such as an extrusion lamination method in which a molten thin film of extruded thermoplastic polyester resin or the like is attached to a metal sheet.

However, in the film lamination method, for convenience of film formation, it is difficult to control a film thickness to be small, and thus the thickness of the film tends to increase, which may be problematic in terms of economic efficiency.

In place of the organic resin-coated metal sheet according to such a film lamination method, it has also been proposed to produce a drawn/ironed can under a dry condition from a coated metal sheet obtained by forming a coating film on a metal sheet by a coating method capable of forming a film with a small thickness.

For example, JP 3872998 B proposes a coated metal sheet for a drawn/ironed can, the coated metal sheet being a double-sided coated metal sheet and including a film to be on a can inner surface side after processing and a film to be on a can outer surface side after processing, the film to be on the can inner surface side after processing having a dry coating amount of 90 to 400 mg/100 $cm^2$ and a glass transition temperature of 50 to 120° C. and having a pencil hardness of H or greater, an elongation percentage of 200 to 600%, and a kinetic friction coefficient of 0.03 to 0.25 under a test condition of 60° C., and the film to be on the can outer surface side after processing having a dry coating amount of 15 to 150 mg/100 $cm^2$ and a glass transition temperature of 50 to 120° C. and having a pencil hardness of H or greater under a test condition of 60° C.

SUMMARY

In a drawn/ironed can molded under a dry condition from a coated metal sheet, after molding a can body, adhesion between a coating film and a metal substrate (hereinafter, sometimes referred to as "coating film adhesion") has been sometimes significantly reduced due to a residual stress in the coating film generated by severe drawing and ironing. This residual stress can be removed by performing heat treatment on the can body in a predetermined condition, but in a case where such heat treatment is performed, along with rapid release of the residual stress in the coating film generated by severe processing, shrinkage force acts on the interface between the coating film and the metal substrate, and in particular, in a thinned site of a can trunk portion where processing is severe, metal exposure may occur due to peeling of the coating film from the metal substrate, leading to reduction in coating film covering property.

However, the above-described JP 3872998 B proposes a coated metal sheet capable of withstanding drawing and ironing by forming, on a surface of the coated metal sheet to be on the can inner surface side, a coating film that can express hardness, elongation percentage, and the like even when heat near 60° C. is generated by consecutive drawing and ironing. Meanwhile, there is neither finding on removal of residual stress by the heat treatment after molding the drawn/ironed can using the coated metal sheet nor finding on coating film peeling due to the heat treatment, and thus JP 3872998 B does not solve such issues.

Accordingly, an object of the disclosure is to provide a drawn/ironed can having excellent coating film peeling resistance that does not cause coating film peeling due to heat treatment after molding, suppressing metal exposure, having high coating film covering property even after heat treatment, and having excellent corrosion resistance.

In addition, another object of the disclosure is to provide a coated metal sheet for a drawn/ironed can having a coating film that does not cause issues as described above.

According to the disclosure, there is provided a drawn/ironed can including an inner surface coating film on at least a can inner surface side, in which the inner surface coating film contains a polyester resin and a curing agent, and a stress relaxation ratio after 10 minutes of the inner surface coating film in a can bottom portion is 50% or greater at 1% elongation under a test condition of 100° C.

In the drawn/ironed can of the disclosure, preferably:

1. the curing agent contained in the inner surface coating film is a resol-type phenolic resin and/or an amino resin,
2. the curing agent contained in the inner surface coating film is m-cresol-based resol-type phenolic resin,
3. the inner surface coating film further contains an acid catalyst,
4. a content of the acid catalyst in the inner surface coating film is less than 0.5 parts by mass per 100 parts by mass of the polyester resin, 5. the polyester resin contained in the inner surface coating film contains 20 mol % or greater of one, or two or more types selected from ethylene glycol, propylene glycol, 1,4-butanediol, 2-methyl-1,3-propanediol, and diethylene glycol, when a total amount of polyhydric alcohols constituting the polyester resin is 100 mol %,
6. the drawn/ironed can further includes an outer surface coating film on a can outer surface side, the outer surface coating film containing a polyester resin ad a curing agent and having the stress relaxation ratio of the outer surface coating film in a can bottom portion of higher than 40%,
7. a thickness of a central portion of a can trunk is 20 to 75% of a thickness of a central portion of the can bottom,
8. a thickness of the inner surface coating film in the central portion of the can trunk is 20 to 75% of a thickness of the inner surface coating film in the central portion of the can bottom,
9. a thickness ratio of the inner surface coating film and a metal substrate (thickness of the inner surface coating film/thickness of the metal substrate) is substantially identical between the can bottom portion and the can trunk portion,
10. a heat shrinkage rate of the inner surface coating film in the central portion of the can trunk represented by the following formula is 30% or less:

$$\text{Heat shrinkage rate (\%)}=(\Delta L_1/L_0)\times 100$$

$L_0$: an initial length of the coating film isolated from the central portion of the can trunk in a height direction $\Delta L_1$: a maximum shrinkage length, in the height direction, of the coating film of a portion corresponding to $L_0$ when temperature is raised from 30° C. to 200° C. at a temperature raising rate of 5° C./min while applying a load of $5.20\times10^5$ N/m$^2$ per unit area, and 11. a covering degree of the inner surface coating film is less than 200 mA in terms of ERV.

According to the disclosure, there is also provided a coated metal sheet for a drawn/ironed can including coating films on both surfaces, in which an inner surface coating film of a surface to be on a can inner surface side after drawing and ironing includes a polyester resin and resol-type phenolic resin and/or an amino resin as a curing agent, an outer surface coating film of a surface to be on a can outer surface side after drawing and ironing includes a polyester resin and an amino resin as a curing agent, a stress relaxation ratio after 10 minutes at 1% elongation of the inner surface coating film is 50% or greater under a test condition of 100° C., and a stress relaxation ratio after 10 minutes at 1% elongation of the outer surface coating film is higher than 40% under a test condition of 100° C.

In the coated metal sheet for a drawn/ironed can of the disclosure, the polyester resin contained in the inner surface coating film preferably contains 20 mol % or greater of one, or two or more types selected from ethylene glycol, propylene glycol, 1,4-butanediol, 2-methyl-1,3-propanediol, and diethylene glycol when the total amount of polyhydric alcohol components constituting the polyester resin is 100 mol %.

According to the disclosure, there is provided a drawn/ironed can including the coated metal sheet for a drawn/ironed can.

In the drawn/ironed can of the disclosure, preferably, 1. a thickness of a central portion of a can trunk is 20 to 75% of a thickness of a central portion of a can bottom,
2. a thickness of the inner surface coating film in the central portion of the can trunk is 20 to 75% of a thickness of the inner surface coating film in the central portion of the can bottom, and
3. a covering degree of the inner surface coating film is less than 200 mA in terms of ERV.

In light of the above-described background, as a result of diligent examination on peeling of a coating film due to heat treatment of a drawn/ironed can including a coated metal sheet, the present inventors have found that ease of coating film peeling during heat treatment is correlated with behavior of stress relaxation (stress relaxation ratio) when the coating film is elongated under a predetermined condition, and have found a range of the stress relaxation ratio with which coating film peeling is not generated and a coating film that can exhibit the stress relaxation ratio.

In other words, in the drawn/ironed can of the disclosure, there is no coating film peeling during heat treatment, and thus even after heat treatment is performed after molding the drawn/ironed can, the covering degree of the inner surface coating film represented in terms of ERV is less than 200 mA, indicating that metal exposure is effectively prevented, which achieves excellent corrosion resistance.

Furthermore, a coated metal sheet that may form such a drawn/ironed can has excellent elongation property and processability of the coating film, and even when subjected to severe processing such as drawing and ironing under a dry condition, not only breakage in a can trunk portion (in the disclosure, sometimes referred to as trunk breakage) but also metal exposure is effectively prevented, and thus, the coated metal sheet has a high covering property of coating film and has excellent can forming processability. That is, in the disclosure, a specific combination of a polyester resin and a curing agent is used as the polyester resin and the curing agent constituting the coating film to control a curing degree, a crosslinking density, and the like of the coating film, whereby excellent can forming processability is exhibited, and the stress relaxation ratio is controlled to reduce the residual stress generated by can forming processing, whereby coating film peeling at the time of heat treatment after molding a can body can be effectively suppressed, so that it is possible to provide a drawn/ironed can having a high covering property of the coating film and excellent corrosion resistance.

BRIEF DESCRIPTION OF EMBODIMENTS

Coated Metal Sheet

As described above, a coated metal sheet used for molding a drawn/ironed can of the disclosure is a coated metal sheet having an inner surface coating film on a surface to be on a can inner surface side after drawing and ironing, and has important characteristics that the inner surface coating film contains a polyester resin and a curing agent, and a stress relaxation ratio after 10 minutes at 1% elongation of the inner surface coating film is 50% or greater under a test condition of 100° C.

As is evident from a measurement method described below, an elongation strain of 1% is imparted to the coating film under a test condition of 100° C. using a thermomechanical analyzer or the like, a temporal change of stress is measured in a state where the strain is held, and the above-described stress relaxation ratio in the disclosure is calculated by the following formula (1):

$$\text{Stress relaxation ratio (\%)}=(\Delta 1-\Delta 2)/\Delta 1\times 100 \quad (1)$$

where Δ1 is a stress when an isolated inner surface coating film is elongated by 1%, and Δ2 is a stress after 10 minutes.

In a case where the coated metal sheet is used to mold a drawn/ironed can at a high speed under a dry condition, the coated metal sheet is subjected to severe processing and/or deformation with temperature rising due to heat generation of the processing. At the time, large deformation is added by can forming processing to the coating film formed on the coated metal sheet, and thus residual stress is generated in the coating film after the processing. In particular, in a case where a main agent resin such as a polyester resin constituting the coating film is highly crosslinked with a curing agent, the stress generated by the processing is unlikely to be relaxed and residual stress tends to increase. It is thought that when heat treatment is performed on a can body after molding in a state where the residual stress in the coating film remains large, and the can body is heated to a grass transition temperature of the polyester resin or higher, shrinkage force acts on an interface between the coating film and the substrate, whereby the coating film is peeled off to expose metal.

That the stress relaxation ratio is large in the coating film of the coated metal sheet means that in a case where the coated metal sheet is molded at a high speed, and the coating film is processed in a high temperature state due to heat generation of the processing, the stress generated by the processing is likely to be alleviated immediately, that is, the residual stress in the coating film after the processing is reduced. This makes it possible to reduce the shrinkage force generated at the interface between the coating film and the metal substrate due to relaxation of the residual stress, and as a result, coating film peeling is prevented from occurring. This is also clear from results of Examples described below, and if the stress relaxation ratio of the inner surface coating film is less than 50%, it is difficult to suppress occurrence of coating film peeling by heat treatment.

As described above, the coated metal sheet used for molding the drawn/ironed can of the disclosure is a coated metal sheet having at least an inner surface coating film on a surface to be on a can inner side after drawing and ironing, in which the inner surface coating film contains a polyester resin and a curing agent, and desirably, the stress relaxation ratio described above of the inner surface coating film is in a range of 50% or greater, preferably from 50 to 95%, more preferably from 54 to 90%, further preferably from 54 to 85%, particularly preferably from 54 to 80%, and most preferably from 60 to 80%.

Furthermore, the coated metal sheet further has an outer surface coating film on a surface to be on a can outer surface side after drawing and ironing, the outer surface coating film also contains a polyester resin and a curing agent, and desirably, the stress relaxation ratio described above of the outer surface coating film is in a range of more than 40%, preferably from 45 to 95%, more preferably from 50 to 90%, further preferably from 54 to 85%, particularly preferably 54 to 80%, and most preferably 60 to 80%.

By using the coated metal sheet having at least the inner surface coating film on the surface to be the can inner surface as described above to mold the drawn/ironed can, it is possible to cover the entirety with the inner surface coating film continuous from the bottom portion to the trunk portion on the can inner surface side.

Furthermore, in a case where a double-sided coated metal sheet also having the outer surface coating film on the surface to be the can outer surface after drawing and ironing is used, it is possible to cover the entirety with the outer surface coating film continuous from the bottom portion to the trunk portion on the can outer surface side. The outer surface coating film of the coated metal sheet of the disclosure has excellent retort resistance, and thus, it is possible to obtain a drawn/ironed can excellent in retort resistance of the can outer surface. In general, the bottom portion of the drawn/ironed can often includes a bottom part located in a central portion, a ground-contacting portion (rim) lowering from a periphery of the bottom part, and a chime portion extending outward and upward at an angle from the ground-contacting portion to be connected to a lower end of the trunk portion. In a drawn/ironed can obtained by molding an uncoated metal sheet using a coolant in the related art, a coating material for improving transportability of a can body needs to be applied on the ground-contacting portion on the outer surface side immediately after molding the can body, and furthermore, in a case where the chime portion and the bottom part are also coated in consideration of retort resistance, after inner surface coating and print coating on the trunk portion of the outer surface, the chime portion and the bottom part on the outer surface side each need to be coated with a different coating composition using a coating method or device different from the one used for coating the ground-contacting portion. This leads to an increase in the number of processes, which may result in poor performance in terms of productivity and economic efficiency. On the other hand, as in the disclosure, in a case where the coated metal sheet having the outer surface coating film on the surface to be the can outer surface is used to mold the drawn/ironed can, it is possible to cover the entirety with the identical outer surface coating film continuously from the bottom portion to the trunk portion on the can outer surface side, so that it is unnecessary to coat the chime portion, the ground-contacting portion, and the bottom part that constitute the can bottom portion with different coating compositions using different coating methods or devices, which results in excellent performance in terms of productivity and economic efficiency.

In the coated metal sheet according to the disclosure, preferably, the glass transition temperature (Tg) of the inner surface coating film is in a range of 30° C. or higher, preferably higher than 40° C., more preferably higher than 50° C. and 120° C. or lower, further preferably from 60° C. to 110° C., particularly preferably higher than 65° C. and 100° C. or lower, and most preferably from 68 to 90° C. In a case where Tg is lower than the range described above, when a can body after molding is filled with a content, a flavor (perfume) component of the content is likely to be sorbed, which may result in poor flavor sorption resistance, and a barrier property of the coating film is reduced, which may result in poor corrosion resistance. On the other hand, in a case where Tg is higher than 120° C., the coating film may have reduced can forming processability and metal exposure may occur by molding, which leads to a poor covering property of the inner surface coating film, resulting in poor corrosion resistance.

In addition, preferably, Tg of the outer surface coating film is in a range of 30° C. or higher, preferably higher than 40° C., more preferably higher than 50° C. and 120° C. or lower, further preferably from 60° C. to 110° C., particularly preferably greater than 65° C. and 100° C. or lower, and most preferably from 68 to 90° C. In a case where Tg is lower than the range described above, hardness of the coating film is reduced, and thus, external surface defects such as coating film scratch may occur. On the other hand, in a case where Tg is higher than 120° C., the can forming processability of the coating film is reduced, and metal exposure may occur by molding, which results in a poor covering property of the coating film on the outer surface.

Furthermore, preferably, the film thickness of the inner surface coating film is in a range of from 0.2 to 20 μm, preferably from 1 to 12 μm, and more preferably more than 2 μm and 12 μm or less, as a dry film thickness. In addition, preferably, the dry coating film weight is in a range of from 3 to 300 mg/dm$^2$, preferably from 15 to 150 mg/dm$^2$, and more preferably greater than 25 mg/dm$^2$ and 150 mg/dm$^2$ or less. In a case of a thinner film than the above range, metal exposure is likely to occur during molding, leading to a poor covering property of the inner surface coating film. On the other hand, in a case of a thicker film than in the above range, the internal stress generated during processing increases, so that coating film peeling becomes more likely to occur during heat treatment after drawing and ironing, and the film thickness increases beyond necessity, which results in inferior economic efficiency.

Furthermore, in a case where a content to be filled in the drawn/ironed can is an acidic beverage having a strong corrosive property, it is necessary to make the film thickness relatively large to ensure corrosion resistance, and thus, preferably, the thickness is in a range of greater than 6 μm and 12 μm or less, and preferably from 6.5 to 10 μm. In addition, preferably, the dry coating film weight is in a range of greater than 85 mg/dm$^2$ and 150 mg/dm$^2$ or less, and preferably from 90 to 140 mg/dm$^2$. In a case of a thinner film than the above range, the corrosion resistance is inferior, and in a case of exceeding the above range, the coating film tends to be peeled off during heat treatment after drawing and ironing molding.

On the other hand, in a case where a content to be filled in the drawn/ironed can is a low acidic beverage or the like having a relatively weak corrosive property, the corrosion resistance can be ensured even in a relatively thin film, and thus the thickness is in a range of 1 μm or greater and less than 6.5 μm, preferably greater than 2 μm and less than 6.5 μm, and more preferably from 2.5 to 6 μm. Furthermore, preferably, the dry coating film weight is in a range of 15 mg/dm$^2$ or greater and less than 90 mg/dm$^2$, preferably greater than 25 mg/dm$^2$ and less than 90 mg/dm$^2$, and more preferably from 30 to 85 mg/dm$^2$. In a case of a thinner film than the above range, the corrosion resistance is inferior, and in a case of exceeding the above range, the thickness becomes large beyond necessity, which results in inferior economic efficiency.

Furthermore, preferably, the film thickness of the outer surface coating film is in a range of from 0.2 to 20 μm, preferably from 1 to 12 μm, more preferably greater than 2 μm and 10 μm or less, and further preferably greater than 2 μm and 6.5 μm or less, as the dry film thickness. In addition, preferably, the dry coating film weight is in a range of from 3 to 300 mg/dm$^2$, preferably from 15 to 150 mg/dm$^2$, more preferably more than 25 mg/dm$^2$ and 140 mg/dm$^2$ or less, and further preferably greater than 25 mg/dm$^2$ and less than 90 mg/dm$^2$. In a case of a thinner film than the above range, metal exposure is likely to occur during molding, leading to a poor covering property of the coating film on the outer surface. On the other hand, in a case of a thicker film than the above range, the internal stress generated during processing increases, and thus coating film peeling is likely to occur during heat treatment after drawing and ironing molding.

Note that, with respect to the film thicknesses of the inner surface coating film and the outer surface coating film of the coated metal sheet, it is preferable that the inner surface coating film required to have a higher covering property is thicker than the outer surface coating film.

The inner surface coating film and the outer surface coating film of the coated metal sheet and the drawn/ironed can of the disclosure each contain a polyester resin as a main agent and a curing agent.

In the inner surface coating film, the content of the polyester resin, preferably a non-crystalline polyester resin described below, is preferably greater than 50 mass %, more preferably 60 mass % or greater, further preferably 70 mass % or greater, and particularly preferably 80 mass % or greater.

Similarly, in the outer surface coating film, the content of the polyester resin, preferably a non-crystalline polyester resin, is preferably greater than 50 mass %, more preferably 60 mass % or greater, further preferably 70 mass % or greater, and particularly preferably 80 mass % or greater.

Polyester Resin

In the drawn/ironed can and the coated metal sheet of the disclosure, a polyester resin is used as a main agent (main component) constituting the inner surface coating film and the outer surface coating film, and herein, the main agent is defined as a component having the highest content (mass ratio) among resin components constituting the coating film. In the disclosure, a mass rate occupied by the polyester resin among resin components constituting the inner surface coating film and the outer surface coating film is preferably greater than 50 mass %, more preferably 60 mass % or greater, further preferably 70 mass % or greater, and particularly preferably 80 mass % or greater.

As to polyhydric alcohol components (polyol components) constituting the polyester resin used, it is suitable that a polyhydric alcohol component having a molecular structure that is not bulky and is unlikely to cause steric hindrance of polymer chains is contained in an amount of 20 mol % or greater when the total amount of polyhydric alcohol components constituting the polyester resin is 100 mol %. Examples of such a polyhydric alcohol component include, but not limited to, ethylene glycol, propylene glycol, 1,4-butanediol, 2-methyl-1,3-propanediol, diethylene glycol, and the like, and it is suitable that at least one, or two or more types selected from these are contained in a total amount of 20 mol % or greater. It is thought that this makes stress relaxation due to rotation of the polymer chains likely to occur when molding the drawn/ironed can from the coated metal sheet, and it is presumed that as a result, the residual stress of the coating film after molding is reduced, leading to suppression of coating film peeling during heat treatment. Note that, examples of the bulky polyols include, but not limited to, alicyclic polyols such as 1,4-cyclohexanedimethanol, neopentyl glycol, and the like, and it is presumed that in such a polyhydric alcohol, stress relaxation due to rotation of molecular chains by steric hindrance is relatively unlikely to occur.

Preferably, the glass transition temperature (Tg) of the polyester resin is in a range of 30° C. or higher, preferably higher than 40° C., more preferably higher than 50° C. and 120° C. or lower, further preferably from 60° C. to 110° C., particularly preferably higher than 65° C. and 100° C. or lower, and most preferably from 68 to 90° C. If Tg is lower than the above range, when a content is filled in a container produced by drawing and ironing as described above, a flavor component (perfume component) contained in the content easily diffuses into the coating film due to an increase in mobility of the resin, and thus, a sorption amount of the flavor component is increased, so that flavor sorption resistance may be deteriorated, and heat resistance, corrosion resistance, and retort resistance may be also deteriorated. On the other hand, in a case where Tg is higher than 120° C., the processability and elongation property of the coating film are reduced, which results in poor can forming processability, so that metal exposure may occur by molding, and as a result, the covering property of the coating film after molding may be deteriorated, and the stress relaxation ratio may be reduced to deteriorate the coating film peeling resistance.

In the disclosure, two or more types of polyester resins having each different Tg can be blended for use. and by blending polyester resins having each different Tg, it may be possible to form a coating film that is excellent in impact resistance and unlikely to generate a coating film defect even when subjected to external impact.

In the case as well, it is sufficient that $Tg_{mix}$ of the polyester resin blend calculated by the following formula (2) is within the Tg range described above:

$$1/Tg_{mix}=(W1/Tg1)+(W2/Tg2)+\ldots+(Wm/Tgm) \quad (2)$$

$$W1+W2+\ldots+Wm=1$$

In the formula, $Tg_{mix}$ represents the glass transition temperature (K) of the polyester resin blend, and Tg1, Tg2, . . . , and Tgm each represent the glass transition temperature (K) of each of polyester resins used (polyester resin 1, polyester resin 2, . . . , and polyester resin m). W1, W2, . . . , and Wm each represent a mass fraction of each of the polyester resins (polyester resin 1, polyester resin 2, . . . , and polyester resin m).

Examples of a polyvalent carboxylic acid component constituting the polyester resin include: aromatic dicarboxylic acids such as terephthalic acid, isophthalic acid, orthophthalic acid, and 2,6-naphthalenedicarboxylic acid; aliphatic dicarboxylic acids such as succinic acid, glutaric acid, adipic acid, azelaic acid, sebacic acid, dodecanedioic acid, and dimer acid; unsaturated dicarboxylic acids such as maleic acid (maleic anhydride), fumaric acid, and terpene-maleic adducts; alicyclic dicarboxylic acids such as 1,4-cyclohexanedicarboxylic acid, tetrahydrophthalic acid, hexahydroisophthalic acid, and 1,2-cyclohexenedicarboxylic acid; and trivalent or higher valent carboxylic acids such as trimellitic acid (trimellitic anhydride), pyromellitic acid (pyromellitic anhydride), and methylcyclohexenetricarboxylic acid. From these, one, or two or more can be selected and used. Among the polyvalent carboxylic acids described above, it is preferable to use one or more selected from the group consisting of isophthalic acid, orthophthalic acid, terephthalic acid, 2,6-naphthalenedicarboxylic acid, trimellitic acid, adipic acid, sebacic acid, fumaric acid, maleic acid, dimer acid, and 1,4-cyclohexanedicarboxylic acid.

In the disclosure, from the perspective of hardness, heat resistance, flavor sorption resistance, retort resistance, and the like of the resulting coating film, when the total amount of polyvalent carboxylic acid components constituting the polyester resin is 100 mol %, it is preferable to contain at least one, or two or more selected from terephthalic acid, orthophthalic acid, isophthalic acid, and 2,6-naphthalenedicarboxylic acid, each of which is an aromatic dicarboxylic acid, in a total amount of 60 mol % or greater, preferably 70 mol % or greater, more preferably 80 mol % or greater, and further preferably 90 mol % or greater. In addition, among the aromatic dicarboxylic acids described above, terephthalic acid and isophthalic acid are particularly preferable, and when the total amount of the polyvalent carboxylic acids constituting the polyester resin is 100 mol %, the total amount of terephthalic acid and isophthalic acid is preferably 60 mol % or greater, more preferably 70 mol % or greater, further preferably 80 mol % or greater, and particularly preferably 90 mol % or greater.

As the polyhydric alcohol components constituting the polyester resin, as described above, when the total amount of the polyhydric alcohol components constituting the polyester resin is 100 mol %, it is suitable to contain at least one, or two or more selected from ethylene glycol, propylene glycol, 1,4-butanediol, 2-methyl-1,3-propanediol, and diethylene glycol in a total amount of 20 mol % or greater, preferably 30 mol % or greater, more preferably 40 mol % or greater, further preferably 50 mol % or greater, particularly preferably 60 mol % or greater, and most preferably 70 mol % or greater.

As a residual component of the polyhydric alcohol components, one or a combination of two or more can be used from aliphatic glycols such as 1,2-butanediol, 1,3-butanediol, neopentyl glycol, 1,5-pentanediol, 1,6-hexanediol, 3-methyl-1,5-pentanediol, 2-ethyl-2-butyl-1,3-propanediol, 2,4-diethyl-1,5-pentanediol, 1-methyl-1,8-octanediol, 3-methyl-1,6-hexanediol, 4-methyl-1,7-heptanediol, 4-methyl-1,8-octanediol, 4-propyl-1,8-octanediol, and 1,9-nonanediol; ether glycols such as diethylene glycol, triethylene glycol, polyethylene glycol, polypropylene glycol, and polytetramethylene glycol; alicyclic polyalcohols such as 1,4-cyclohexanedimethanol, 1,3-cyclohexanedimethanol, 1,2-cyclohexanedimethanol, tricyclodecane glycols, and hydrogenated bisphenols; and trihydric or higher polyalcohols such as trimethylolpropane, trimethylolethane, and pentaerythritol.

The polyester resin can be produced by a known method such as polycondensation of one or more types of the polyvalent carboxylic acid components described above and one or more types of the polyhydric alcohol components described above, a method of depolymerization after polycondensation with a polyvalent carboxylic acid component such as terephthalic acid, isophthalic acid, trimellitic anhydride, trimellitic acid, or pyromellitic acid, or ring-opening addition of an acid anhydride such as phthalic anhydride, maleic anhydride, trimellitic anhydride, or ethylene glycol bis-trimellitate dianhydride after polycondensation.

From the perspective of curability, retort whitening resistance, adhesion to the metal substrate, and the like, desirably, an acid value of the polyester resin is in a range of from 0.1 to 40 mg KOH/g, preferably from 0.5 to 25 mg KOH/g, more preferably from 1 to 10 mg KOH/g, further preferably higher than 2.5 mg KOH/g and 10 mg KOH/g or less, particularly preferably from 2.5 to 8 mg KOH/g, and most preferably from 3 to 7 mg KOH/g. In a case where the acid value is lower than the above range, the adhesion of the metal substrate and the coating film may be reduced. On the other hand, in a case where the acid value is higher than the above range, as compared to a case where the acid value is in the above range, the coating film becomes likely to absorb water, which may reduce the retort resistance, and the number of reaction points with the curing agent increases to make the crosslinking density high, and can forming processability and coating film peeling resistance are reduced to cause metal exposure, which may reduce the covering property of the coating film.

Note that in a case where the polyester resin is a blend body in which two or more types of polyester resins are blended, the sum of the values each obtained by multiplying an acid value and a mass fraction of each of the polyester resins is defined as an average acid value of the blend body ($AV_{mix}$), and the average acid value is only required to be within the acid value range described above.

The hydroxyl value of the polyester resin is not limited to, but preferably 20 mg KOH/g or less, and more preferably 10 mg KOH/g or less.

The number average molecular weight (Mn) of the polyester resin is not limited to, but preferably in a range of from 1000 to 100000, more preferably 3000 to 50000, and further preferably from 5000 to 20000, preferably from the perspective of can forming processability. When Mn is smaller than the above range, the coating film may become brittle to be poor in the can forming processability, and when Mn is greater than the above range, the paint stability may be reduced.

Furthermore, the polyester resin is preferably a non-crystalline polyester resin from the perspective of can forming processability, dent resistance, and coating material formation. Here, "non-crystalline" means that no clear melting point of a crystalline component is exhibited in measurement by a differential scanning calorimeter (DSC). As compared to a crystalline polyester resin, the non-crystalline polyester resin has an excellent solubility in a solvent and is easily made into a coating material, and it is possible to form a coating film excellent in can forming processability and dent resistance.

The hydroxyl value of the polyester resin is not limited to, but preferably 20 mg KOH/g or less, and more preferably 10 mg KOH/g or less.

Curing Agent

As the curing agent used in the disclosure, a curing agent that reacts with a functional group of the polyester resin, for example, a carboxyl group or a hydroxyl group to form a crosslinking structure is used.

Examples of such a curing agent can include an isocyanate compound, a resol-type phenolic resin, an amino resin, an epoxy group-containing compound, an oxazoline group-containing compound, a carbodiimide group-containing compound, a β-hydroxyalkylamide compound, and the like. In particular, a resol-type phenolic resin and an amino resin are suitable from the perspective of curability, hygiene, and the like.

In the coated metal sheet and the drawn/ironed can of the disclosure, as a coating composition for forming the inner surface coating film (hereinafter, sometimes referred to as "inner surface coating composition"), a resol-type phenolic resin or an amino resin is suitable, and in particular, a resol-type phenolic resin can be preferably used from the perspective of can forming processability. As a coating composition for forming the outer surface coating film (hereinafter, sometimes referred to as "outer surface coating composition"), an amino resin that can form a transparent coating film without coloring derived from the curing agent can be preferably used. On the other hand, a coating film to be formed becomes yellow, and thus attention needs to be paid in a case where the resol-type phenolic resin described above is used in the coating composition for forming the outer surface coating film.

Resol-type Phenolic Resin

The resol-type phenolic resin is a resin obtained by reacting a phenolic compound and formaldehyde in the presence of an alkaline catalyst. Examples of the phenolic compound used include o-cresol, p-cresol, p-tert-butylphenol, p-ethylphenol, 2,3-xylenol, 2,5-xylenol, phenol, m-cresol, m-ethylphenol, 3,5-xylenol, and m-methoxyphenol. From these, one, or two or more can be mixed and used.

From the perspective of curability, among the above phenolic compounds, a resol-type phenolic resin containing a phenolic compound that becomes three-functional in the reaction with formaldehyde as a starting raw material in an amount of more than 50 mass %, preferably 60 mass % or greater, and further preferably 80 mass % or greater is preferable. Examples of the phenolic compound that becomes three-functional in the reaction with formalin include phenol, m-cresol, m-ethylphenol, 3,5-xylenol, and m-methoxyphenol, and among these, one, or two or more can be selected and used. When the amount of these trifunctional phenolic compounds is 50 mass % or less, sufficient curability cannot be achieved, so that the degree of curing of the coating film may decrease. Among these three-functional phenolic compounds, from the perspective of curability, m-cresol is more preferable, and a resol-type phenolic resin containing more than 50 mass % of me-cresol as a starting raw material (hereinafter, sometimes referred to as "m-cresol-based resol-type phenolic resin") is particularly preferable. As a result, it is possible to achieve a sufficient degree of curing of the coating film, which is desirable from the perspective of heat resistance, corrosion resistance, retort resistance, and the like of the coating film. As the m-cresol-based resol-type phenolic resin, preferably, one containing m-cresol as a starting raw material in an amount of more than 50 mass %, preferably 60 mass % or greater, and further preferably 80 mass % or greater is preferable.

Other than the above phenolic compounds that become three-functional, in a case where a phenolic compound that becomes bifunctional in the reaction with formaldehyde is used as the starting raw material, preferably, the content thereof is less than 50 mass %, preferably less than 40 mass %, and more preferably less than 20 mass %. When it is 50 mass % or greater, the curability may decrease. Examples of the phenol compound to be bifunctional include o-cresol, p-cresol, p-tert-butylphenol, p-ethylphenol, 2,3-xylenol, 2,5-xylenol, and the like.

Furthermore, as the resol-type phenolic resin used in the disclosure, from the perspective of compatibility with the polyester resin and curability, it is possible to preferably use one obtained by alkyl-etherifying (alkoxy-methylating) a part or all of methylol groups contained with alcohols having 1 to 12 carbon atoms. The proportion of the methylol groups to be alkyl-etherified is preferably 50% or greater, more preferably 60% or greater, and further preferably 80% or greater. When the proportion of alkyl etherification is less than 50%, the compatibility with the polyester resin becomes low, and the coating film may have a turbidity or sufficient curability cannot be achieved. Examples of the alcohol used in alkyl etherification include monovalent alcohols having from 1 to 8 carbon atoms, preferably from 1 to 4 carbon atoms, and examples of suitable monovalent alcohols can include methanol, ethanol, n-propanol, n-butanol, isobutanol, and the like, and n-butanol is more preferable.

The number of the alkyl-etherified methylol groups (alkoxy methyl groups) is preferably 0.3 or greater, preferably from 0.5 to 3, as the average of the alkoxy methyl groups per phenol nucleus. When the number is less than 0.3, curability with the polyester resin is deteriorated. The number average molecular weight (Mn) of the resol-type phenolic resin is preferably in a range of from 500 to 3000, preferably from 800 to 2500. When Mn is smaller than the above range, the crosslinking density of the coating film formed tends to increase, and thus stress is less likely to be relaxed during molding, so that the coating film peeling resistance may be deteriorated. On the other hand, when Mn is larger than the above range, the curability is deteriorated and as a result, the heat resistance and corrosion resistance, retort resistance, and the like of the coating film may be deteriorated.

Amino Resin

Examples of the amino resin include a methylolated amino resin obtained by reaction of an amino component such as melamine, urea, benzoguanamine, acetoguanamine, steroguanamine, spiroguanamine, or dicyandiamide, and an aldehyde component such as formaldehyde, paraformaldehyde, acetaldehyde, or benzaldehyde. One obtained by alkyl-etherifying a part or all of the methylol groups of the methylolated amino resin by an alcohol having 1 to 6 carbon atoms is also included in the above amino resin. These can be used alone or in combination of two or more. As the amino resin, from the perspective of hygiene, can forming processability, curability, and the like, a methylolated amino resin using benzoguanamine (benzoguanamine resin) or a methylolated amino resin using melamine (melamine resin) is preferable.

As the benzoguanamine resin, benzoguanamine resins obtained by alkyl-etherifying a part or all of the methylol groups of a methylolated benzoguanamine resin with an alcohol such as methanol, ethanol, n-butanol, or i-butanol, for example, a methyl-etherified benzoguanamine resin, an ethyl-etherified benzoguanamine resin, a butyl-etherified benzoguanamine resin, a mixed-etherified benzoguanamine resin of methyl ether and butyl ether, a mixed-etherified benzoguanamine resin of methyl ether and ethyl ether, and a mixed-etherified benzoguanamine resin of ethyl ether and butyl ether are preferable. Among these, the methyl-etherified benzoguanamine resin is more preferable, and a methyl-etherified benzoguanamine resin of an imino group/methylol group-containing partial etherification type is particularly preferable.

As the melamine resin, a melamine resin obtained by alkyl-etherifying a part or all of methylol groups of the methylolated melamine resin by an alcohol such as methanol, ethanol, n-butanol, or i-butanol, for example, a methyl-etherified melamine resin, an ethyl-etherified melamine resin, a butyl-etherified melamine resin, or a mixed etherified melamine resin of methyl ether and butyl ether, a mixed etherified melamine resin of methyl ether and ethyl ether, and a mixed etherified melamine resin of ethyl ether and butyl ether are preferable. Among these, the methyl-etherified melamine resin is more preferable, and a methyl-etherified melamine resin of a full etherification type is particularly preferable.

Examples of the functional groups included in the melamine resin and the benzoguanamine resin described above include an imino group (>NH), an N-methylol group (>$NCH_2OH$), and an N-alkoxymethyl group (>$NCH_2OR$; R is an alkyl group), and these functional groups act as a reaction point in a crosslinking reaction with a carboxyl group (—COOH) or a hydroxyl group (—OH) contained in the polyester resin, which is a main agent, or a self-condensation reaction between amino resins (note that the imino group only contributes to the self-condensation reaction). Note that with respect to the number of the reaction points (functional groups) described above, when compared between monomers of the melamine resin and the benzoguanamine resin, it is thought that the number of the reaction points of the melamine resin is larger based on the molecular structure. As a result, while the melamine resin is excellent in curability, the crosslinking density of the formed coating film tends to increase, and the stress relaxation ratio may be reduced depending on the blended amount, so that coating film peeling may occur during heat treatment. On the other hand, while the benzoguanamine resin has poor curability as compared to the melamine resin, the crosslinking density of the formed coating film is less likely to increase, so that it can be said that the benzoguanamine resin is more suitable than the melamine resin from the perspective of coating film peeling resistance. Therefore, in order to balance curability and coating film peeling resistance, a mixed amino resin in which the melamine resin and the benzoguanamine resin are used in combination and mixed in a predetermined ratio may be used. In this case, the blended amount ratio (mass ratio) of the melamine resin and the benzoguanamine resin is from 95:5 to 5:95, preferably from 90:10 to 10:90, more preferably from 80:20 to 15:85, and further preferably from 70:30 to 25:75.

The curing agent is desirably blended in a range of from 1 to 40 parts by mass, preferably from 1 to 30 parts by mass, and more preferably from 2 to 20 parts by mass, with respect to 100 parts by mass of the polyester resin.

In a case where the resol-type phenolic resin is used as the curing agent, it is preferably blended in a range of from 2 to 40 parts by mass, preferably from 3 to 30 parts by mass, more preferably from 3 to 25 parts by mass, further preferably from 3 to 20 parts by mass, and particularly preferably from 4 to 15 parts by mass, with respect to 100 parts by mass of the polyester resin as the main agent (solid content). On the other hand, in a case where the melamine resin is used as the curing agent, it is preferably blended in an amount of from 1 to 15 parts by mass, preferably 1 part by mass or greater and less than 10 parts by mass, more preferably from 2 to 5.5 parts by mass, and particularly preferably from 2 to 5 parts by mass, with respect to 100 parts by mass of the polyester resin. In a case where the benzoguanamine resin is used as the curing agent, it is preferably blended in an amount of from 4 to 40 parts by mass, preferably from 5 to 30 parts by mass, more preferably from 6 to 28 parts by mass, further preferably from 8 to 25 parts by mass, and particularly preferably from 10 to 24 parts by mass, with respect to 100 parts by mass of the polyester resin. In a case where the mixed amino resin of the melamine resin and the benzoguanamine resin described above is used as the curing agent, it is preferably blended in an amount of from 2 to 25 parts by mass, preferably from 2 to 20 parts by mass, from 2.5 to 15 parts by mass, and 3 parts by mass or greater and less than 10 parts by mass, with respect to 100 parts by mass of the polyester resin.

When the curing agent amount is less than the above range, sufficient curability cannot be achieved, the degree of curing of the coating film is reduced, and the heat resistance tends to decrease. Thus, in a case where the drawn/ironed can is molded at a high speed, temperature rising is more pronounced, so that the coating film may easily stick to a mold during molding. Especially on the can inner surface side, when the can body is removed from a molding punch after drawing and ironing molding, a phenomenon in which the can body sticks to the molding punch to make it difficult to separate the can body from the molding punch (poor stripping property) occurs. As a result, the can body may buckle or break, resulting in a decrease in productivity. On the can outer surface side, an external surface defect such as a coating film scratch may occur.

On the other hand, in a case where the amount of the curing agent is larger than the above range, depending on the curing agent to be used, the can forming processability of the coating film is reduced, so that metal exposure may occur during drawing and ironing, and the crosslinking density of the coating film is increased, whereby stress relaxation becomes difficult during molding, so that it may become difficult to adjust the stress relaxation ratio of the inner surface coating film described above to 50% or greater. As a result, the covering property of the coating film may be deteriorated.

The inner surface coating composition and the outer surface coating composition used in the disclosure are preferably blended with a curing catalyst for promoting the crosslinking reaction of the polyester resin and the curing agent.

As the curing catalyst, a known curing catalyst can be used, and for example, an organic sulfonic acid-based acid catalyst and a phosphoric acid-based acid catalyst such as p-toluenesulfonic acid, dodecylbenzenesulfonic acid, dinonyl naphthalene disulfonic acid, phosphoric acid, alkylphosphoric acid, or an amine-neutralized product thereof can be used. Among the curing catalysts described above, the organic sulfonic acid-based acid catalyst is preferably used, and particularly, dodecylbenzene sulfone or an amine-neutralized product thereof is suitable.

The amount of the curing catalyst is desirably in a range of from 0.01 to 3 parts by mass, preferably from 0.02 to 1.0 parts by mass, more preferably 0.02 parts by mass or greater and less than 0.5 parts by mass, further preferably 0.03 parts by mass or greater and less than 0.3 parts by mass, particularly preferably 0.04 parts by mass or greater and less than 0.2 parts by mass, as a solid content, with respect to 100 parts by mass of the polyester resin. Furthermore, in a case where the amine neutralized product of the acid catalyst (for example, an amine neutralized product of dodecylbenzenesulfonic acid) is used as the curing catalyst, the content of the acid catalyst excluding the amine is only required to be within the above range. In a case where the content of the curing catalyst is smaller than the above range, there is a possibility that the effect of promoting the curing reaction is not sufficiently obtained, while in a case where the content of the curing catalyst is larger than the above range, a further effect is not expected, and the water resistance of the coating film may be reduced, resulting in deterioration of corrosion resistance, retort resistance, and the like. Furthermore, the acid catalyst is localized to the surface of the metal substrate due to acid-base interaction, which may lead to a decrease in adhesion between the coating film and the metal substrate, so that issues such as peeling off of the coating film may occur when molding a can.

Coating Composition

The coating composition that forms the coating film of the coated metal sheet of the disclosure contains at least the polyester resin described above as the main agent and the curing agent described above, and more preferably the curing catalyst (acid catalyst) described above. Note that, in the disclosure, a component having the largest content (mass ratio) is defined as the main agent (main component) among solid components (non-volatile components excluding volatile materials such as water or solvent) that forms the coating film in the coating composition. Furthermore, in the coating composition used in the disclosure, among all resin components contained in the coating composition, the content of the polyester resin, preferably the non-crystalline polyester resin, which is the main agent, is preferably greater than 50 mass %, more preferably 60 mass % or greater, further preferably 70 mass % or greater, particularly preferably 80 mass % or greater.

In the disclosure, examples of the form of the coating composition that can be used in forming the coating film include a solvent-type coating composition and an aqueous coating composition. In the disclosure, the solvent-type coating composition is preferable from the perspective of a coating property and the like.

In a case where the coating composition is the solvent-type coating composition, the polyester resin and the curing agent described above, and an organic solvent as a solvent are contained. Note that the solvent-type coating composition according to the present embodiment is defined as a coating composition made into a coating material by dissolving a main agent resin, a curing agent, and the like in a known organic solvent, in which a mass ratio occupied by the organic solvent in the coating composition is 40 mass % or greater.

Examples of the organic solvent include toluene, xylene, aromatic hydrocarbon compounds, ethyl acetate, butyl acetate, methyl ethyl ketone, methyl isobutyl ketone, cyclohexanone, isophoron, methyl cellosolve, butyl cellosolve, ethylene glycol monoethyl ether acetate, diethylene glycol monoethyl ether acetate, ethylene glycol monoacetate, methanol, ethanol, butanol, ethylene glycol monoethyl ether, ethylene glycol monobutyl ether, diethylene glycol monobutyl ether, solvent naphtha, and the like. From these, one, or two or more are selected and used in consideration of solubility, evaporation rate, and the like.

In a case where the coating composition is the aqueous coating composition, an aqueous medium as a solvent is contained together with a known water-dispersible or water-soluble polyester resin and a curing agent.

As the aqueous medium, similarly to the known aqueous coating composition, water, or a medium obtained by mixing water and an organic solvent such as an alcohol or a polyhydric alcohol, a derivative thereof, or the like can be used as the aqueous medium. In a case where the organic solvent is used, it is preferably contained in an amount of from 1 to 45 mass %, and particularly preferably in an amount of from 5 to 30 mass %, with respect to the entire aqueous medium in the aqueous coating composition. The composition containing a solvent in the above range improves film-forming performance.

Such an organic solvent preferably has amphiphilicity, and examples thereof include methyl alcohol, ethyl alcohol, isopropyl alcohol, n-butanol, ethylene glycol, methyl ethyl ketone, butyl cellosolve, carbitol, butyl carbitol, propylene glycol monopropyl ether, propylene glycol ethylene glycol monobutyl ether, propylene glycol monomethyl ether, propylene glycol monobutyl ether, dipropylene glycol monomethyl ether, dipropylene glycol monobutyl ether, tripropylene glycol monomethyl ether, and 3-methyl3-methoxybutanol.

Lubricant

The coating composition may contain a lubricant, as necessary. It is preferable to add from 0.1 parts by mass to 10 parts by mass of the lubricant with respect to 100 parts by mass of the polyester resin.

By adding the lubricant, scratches on the coating film during molding processing can be suppressed, and smoothness of the coating film during molding processing can be improved.

Examples of the lubricant that can be added to the coating composition include a fatty acid ester wax that is an esterified product of a polyol compound and a fatty acid, a silicon-based wax, a fluorine-based wax such as polytetrafluoroethylene, a polyolefin wax such as polyethylene, a paraffin wax, lanolin, a montan wax, a microcrystalline wax, a carnauba wax, a silicon-based compound, vaseline, and the like. One, or two or more of these lubricants can be mixed and used.

Others

To the coating composition, in addition to the above components, a leveling agent, a pigment, a defoaming agent, a coloring agent, and the like, which are blended in a coating composition in the related art, can be added in a known manner.

Further, in a range that does not impair the object of the disclosure, other resin components may be included together with the polyester resin, and for example, a resin such as polyvinyl acetate, ethylene-vinyl acetate copolymer, a polyolefin-based resin, an epoxy resin, a polyurethane resin, an acrylic resin, a polyvinyl chloride-based resin, a polyvinyl chloride-polyvinyl acetate copolymer resin, polyvinyl alcohol, an ethylene-vinyl alcohol copolymer, polyvinyl pyrrolidone, polyvinyl ethyl ether, polyacrylamide, an acrylamide-based compound, polyethylenimine, starch, gum arabic, methylcellulose, or the like may be included.

In the coating composition, it is suitable that the polyester resin is contained in an amount of from 5 to 55 mass % as a solid content. In a case where the amount of the resin solid content is smaller than the above range, an appropriate coating film amount cannot be ensured, leading to poor covering property of the coating film. On the other hand, in a case where the amount of the resin solid content is larger than the above range, workability and coatability may be deteriorated.

Method for Producing Coated Metal Sheet

In the disclosure, as described above, the inner surface coating composition containing the polyester resin as the main agent and the curing agent, preferably the resol-type phenolic resin, is applied onto at least a surface of a metal sheet to be an inner surface. Preferably, onto a surface of the metal sheet to be an outer surface, the outer surface coating composition containing the polyester resin as the main agent and the curing agent, preferably the amino resin, as described above, is further applied.

Baking conditions of the coating composition are appropriately adjusted depending on the types, applied amounts, and the like of the polyester resin, the curing agent, and the metal substrate, and the coating composition described above is preferably heat-cured under conditions of a baking temperature of from 150° C. to 350° C., preferably higher than 200° C. and 320° C. or lower, for 5 seconds or longer, preferably from 5 seconds to 30 minutes, particularly preferably from 5 seconds to 180 seconds, in order to achieve a sufficient degree of curing. In a case where the baking temperature is lower than the above range, the sufficient degree of curing may not be achieved. On the other hand, in a case where the baking temperature is higher than the above range, excessive heating may cause the polyester resin to thermally decompose. In a case where the baking time is shorter than the above range, the sufficient degree of curing may not be achieved, and in a case where the baking time is longer than the above range, economic efficiency and productivity are deteriorated.

Furthermore, in the inner surface coating film and/or the outer surface coating film after baking, preferably, a MEK extraction rate (MEK boiling point, 1 hour), which is an index of degree of curing, is in a range of 50% or less, preferably from 1 to 40%, more preferably from 2 to 30%, further preferably from 3 to 25%, and particularly preferably from 3 to 20%, and when the MEK extraction rate is in the above range, the degree of curing of the coating film is controlled, which is preferred from the perspective of heat resistance, corrosion resistance, retort resistance, and coating film peeling resistance (stress relaxation ratio).

In a case where the MEK extraction rate is higher than the above range, the degree of curing of the coating film tends to decrease, the heat resistance tends to decrease, and thus in a case where the drawn/ironed can is molded at a high speed, temperature is pronouncedly raised, so that the coating film may be likely to stick to the mold during molding. Especially on the can inner surface side, when the can body is removed from a molding punch after drawing and ironing molding, a phenomenon in which the can body sticks to the molding punch to make it difficult to separate the can body from the molding punch (poor stripping property) occurs. As a result, the can body may buckle or break, resulting in a decrease in productivity. On the can outer surface side, an external surface defect such as coating film scratches may occur, and the retort whitening resistance may be deteriorated.

On the other hand, in a case where the MEK extraction rate is lower than 1%, it is difficult to bring the aforementioned stress relaxation ratio into the range described above, and coating film peeling may occur.

The coated metal sheet can be manufactured as follows: coating is performed by a known coating method such as roll coater coating, spray coating, or dip coating as the coating method on at least a surface of the metal sheet to be on the can inner surface side, preferably on both surfaces, and then baking is performed by a heating means such as a coil oven.

Examples of a metal sheet used as the metal substrate of the coated metal sheet include, but not limited to, a hot-rolled steel sheet, a cold-rolled steel sheet, a molten galvanized steel sheet, an electrogalvanized steel sheet, an alloy plated steel sheet, an aluminum-zinc alloy plated steel sheet, an aluminum sheet, a tin plated steel sheet, a stainless steel sheet, a copper sheet, a copper plated steel sheet, a tin-free steel, a nickel plated steel sheet, an ultra-thin tin plated steel sheet, and a chromized steel sheet, and one obtained by subjecting these sheets to various types of surface treatment, for example, phosphoric acid chromate treatment or zirconium-based chemical conversion treatment, application-type treatment in which a water-soluble resin such as polyacrylic acid and a zirconium salt such as aluminum-zirconium carbonate are combined, or the like as necessary can be used.

In the disclosure, among the above metal sheets, the aluminum sheet is preferable, and as the aluminum sheet, in addition to a pure aluminum sheet, an aluminum alloy sheet, specifically, an aluminum alloy sheet of 3000 series, 5000 series, or 6000 series in "JIS H4000" can be preferably used, and the aluminum alloy sheet is suitable from the perspective of strength. As the aluminum alloy sheet, in addition to the surface-treated aluminum alloy sheet that has been subjected to the various types of surface treatment described above, an untreated aluminum alloy sheet can be preferably used because the coating film made of the coating composition described above has excellent adhesion to the metal substrate.

The thickness of the metal sheet is in a range of from 0.1 to 1.00 mm, preferably from 0.15 to 0.40 mm, more preferably from 0.15 to 0.30 mm, and further preferably from 0.20 to 0.28 mm, from the perspective of can body strength and moldability.

In the coated metal sheet of the disclosure, on the inner surface coating film formed on the surface to be on the can inner surface side after drawing and ironing, and/or the outer surface coating film formed on the surface to be on the can outer surface side after drawing and ironing, a coating film made of another coating composition may be formed, as necessary.

Furthermore, in the coated metal sheet of the disclosure, the inner surface coating film and the outer surface coating film made of the above-described coating composition have excellent adhesion to the metal substrate, and thus, it is suitable that the inner surface coating film and/or the outer surface coating film is formed in such a manner to directly come into contact with the metal sheet, which is the metal substrate.

Drawn/Ironed Can

The drawn/ironed can of the disclosure is a drawn/ironed can that is formed by drawing and ironing the coated metal sheet described above and has at least the inner surface coating film on the can inner surface side, and has important characteristics that the inner surface coating film contains a polyester resin and a curing agent, and the stress relaxation ratio of the inner surface coating film after 10 minutes at 1% elongation in the can bottom portion is 50% or higher under a test condition of 100° C.

Desirably, the stress relaxation ratio of the inner surface coating film is in a range of 50% or higher, preferably from 50 to 95%, more preferably from 54 to 90%, further preferably 54 to 85%, particularly preferably 54 to 80%, most preferably 60 to 80%.

In addition, preferably, the drawn/ironed can further includes the outer surface coating film on the can outer surface side, the outer surface coating film contains a polyester resin and a curing agent, and the stress relaxation ratio of the outer surface coating film after 10 minutes at 1% elongation in the can bottom portion is higher than 40% under a test condition of 100° C.

The stress relaxation ratio of the outer surface coating film is in a range of higher than 40%, preferably from 45% to 95%, more preferably from 50 to 90%, further preferably from 54 to 85%, particularly preferably from 54 to 80%, and most preferably from 60 to 80%.

In addition, it is preferable that in the drawn/ironed can, at least the can bottom portion and the can trunk portion on the can inner surface side are continuously covered with the inner surface coating film, and further, it is preferable that the can bottom portion and the can trunk portion on the can outer surface side are continuously covered with the outer surface coating film.

Note that the stress relaxation ratio is measured in the coating film of the can bottom portion of the drawn/ironed can because the extent of processing on the can bottom portion is extremely small as compared to that on the can trunk portion, and thus, it is possible to approximate the coating film of the coated metal sheet before molding, and it has similar characteristics.

Method for Producing Drawn/Ironed Can

The drawn/ironed can of the disclosure can be produced by using the coated metal sheet described above and using a known molding method. The coating film of the coated metal sheet of the disclosure has an excellent elongation property, processability, and adhesion, and thus even during severe drawing and ironing, it is possible to mold the drawn/ironed can without causing trunk breakage or coating film peeling at a can opening end. Note that the coated metal sheet of the disclosure has excellent moldability and lubrication property, and thus it is possible to mold the drawn/ironed can not only in a case of using coolant, but also in a case of performing molding under a dry condition without using coolant.

It is preferable to apply a wax-based lubricant, for example, a paraffin-based wax, white vaseline, palm oil, various natural waxes, a polyethylene wax, or the like, to the surface of the coated metal sheet prior to drawing and ironing, whereby drawing and ironing can be efficiently performed under the dry condition. In the coated metal sheet on which the wax-based lubricant has been applied, a blank is punched by a cupping press, and a drawn cup is molded by a drawing method. In the disclosure, it is desirable that a drawn ratio RD defined by the following formula (3) is in a range of from 1.1 to 2.6, particularly in a range of from 1.4 to 2.6, in total (to the drawn/ironed can). When the drawn ratio is larger than the above range, drawn wrinkles may increase, and cracks may occur in the coating film to cause metal exposure.

$$RD=D/d \tag{3}$$

where D represents a blank diameter and d represents a can trunk diameter.

Next, the drawn cup is subjected to re-drawing, that is, ironing in a single stage or several stages (drawing and ironing) to thin the can trunk portion.

In the disclosure, desirably, an ironed rate R represented by the following formula (4) is in a range of from 25 to 80%, preferably from 40 to 80%, more preferably from 50 to 80%, further preferably from 55 to 75%, particularly preferably from 55 to 70%, and most preferably higher than 60% and 70% or less. When the ironed rate is lower than the above range, it is not possible to achieve sufficient thinning, and thus economic efficiency is insufficient. On the other hand, in a case where the ironed ratio is higher than the above range, there is a risk of metal exposure.

$$R(\%)=(tp-tw)/tp\times 100 \tag{4}$$

where tp represents a thickness of the original coated metal sheet, and tw represents a thickness of the central portion of the can trunk side wall of the drawn/ironed can.

In the drawn/ironed can of the disclosure, preferably, the thickness of the central portion of the can trunk (central portion in the height direction, the thinnest portion) is from 20 to 75%, preferably 20 to 60%, more preferably 20 to 50%, further preferably 25 to 45%, particularly preferably 30 to 45%, and most preferably 30% or greater and less than 40%, of the thickness of the central portion of the can bottom. Similarly, in the thickness of the metal substrate of the drawn/ironed can, preferably, the thickness of the metal substrate in the central portion of the can trunk is from 20 to 75%, preferably 20 to 60%, more preferably 20 to 50%, further preferably 25 to 45%, particularly preferably 30 to 45%, and most preferably 30% or greater and less than 40%, of the thickness of the metal substrate in the central portion of the can bottom. In addition, in a case where the drawn/ ironed can is molded from the coated metal sheet by drawing and ironing, the thickness of the coating film located in the can trunk portion is thinned in the same manner as the metal substrate by the processing. Accordingly, the thickness of the coating film in the central portion of the can trunk is from 20 to 75%, preferably from 20 to 60%, more preferably from 20 to 50%, further preferably from 25 to 45%. particularly preferably 30 to 45%, and most preferably 30% or greater and less than 40%, of the thickness of the coating film in the central portion of the can bottom, which is hardly thinned during can forming.

Preferably, the thickness of the metal substrate in the central portion of the can bottom is from 0.10 to 0.50 mm, preferably from 0.15 to 0.40 mm, more preferably from 0.15 to 0.30 mm, and further preferably from 0.20 to 0.28 mm.

Furthermore, preferably, the film thickness of the inner surface coating film in the central portion of the can bottom is in a range of from 0.2 to 20 μm, preferably from 1 to 12 μm, and more preferably larger than 2 μm and 12 μm or less, as dry film thickness. In addition, preferably, the dry coating film weight is in a range of from 3 to 300 mg/dm$^2$, preferably from 15 to 150 mg/dm$^2$, and more preferably greater than 25 mg/dm$^2$ and 150 mg/dm$^2$ or less. Furthermore, in a case where a content to be filled into the drawn/ironed can is an acidic beverage having a strong corrosion property, preferably, the film thickness is in a range of greater than 6 μm and 12 μm or less, and preferably from 6.5 to 10 μm. In addition, preferably, the dry coating film weight is in a range of greater than 85 mg/dm$^2$ and 150 mg/dm$^2$ or less, and preferably from 90 to 140 mg/dm$^2$. In a case where a content to be filled into the drawn/ironed can is a low acidic beverage or the like having a relatively weak corrosion property, the film thickness is in a range of 1 μm or greater and less than 6.5 μm, preferably greater than 2 μm and less than 6.5 μm, and more preferably from 2.5 μm to 6 μm. Furthermore, preferably, the dry coating film weight is in a range of 15 mg/dm$^2$ or greater and less than 90 mg/dm$^2$, preferably greater than 25 mg/dm$^2$ and 90 mg/dm$^2$, and more preferably from 30 to 85 mg/dm$^2$.

Preferably, the film thickness of the outer surface coating film in the central portion of the can bottom is in a range of from 0.2 to 20 μm, preferably from 1 to 10 μm, more preferably greater than 2 μm and 10 μm or less, and further preferably greater than 2 μm and 6.5 μm or less, as dry film thickness. Furthermore, preferably, the dry coating film weight is in a range of from 3 to 300 mg/dm$^2$, preferably from 15 to 150 mg/dm$^2$, more preferably from 25 to 140 mg/dm$^2$, and further preferably greater than 25 mg/dm$^2$ and less than 90 mg/dm$^2$.

In addition, in a case where the drawn/ironed can is molded from the coated metal sheet having the inner surface coating film by drawing and ironing as described above, the thickness of the inner surface coating film located in the can trunk portion is thinned by the processing in the same manner as the metal substrate located in the can trunk portion. Accordingly, in the drawn/ironed can of the disclosure, the thickness ratio of the inner surface coating film to the metal substrate in the can trunk portion and the thickness ratio of the inner surface coating film and the metal substrate in the can bottom portion are substantially the same. That is, in the drawn/ironed can of the disclosure, the thickness ratio of the inner surface coating film and the metal substrate (=thickness of the inner surface coating film/thickness of the metal substrate) is substantially the same in the can bottom portion and the can trunk portion. Note that "substantially the same" here means that the production error is included in the range, and for example, it means that (thickness of the inner surface coating film/thickness of the metal substrate) of the can trunk portion is in a range of from 0.9 to 1.1 times (thickness of the inner surface coating film/thickness of the metal substrate) of the can bottom portion. Note that the same applies to the outer surface coating film.

Note that desirably, the processing speed of ironing in the single or several stages (moving speed of the punch) is 1500 mm/sec or higher, preferably 3000 mm/sec or higher, more preferably 4000 mm/sec or higher, further preferably 5000 mm/sec or higher, and particularly preferably 6000 mm/sec or higher. By setting the processing speed of ironing to the above speed or higher, processing heat generation becomes large, leading to a high temperature state, which improves processability (elongation) of the coating film. As a result, metal exposure during molding is suppressed, and the covering property of the inner surface coating film and the outer surface coating film after molding can be further improved. Furthermore, by molding at a high temperature, stress relaxation is likely to occur during molding, and thus the residual stress in the coating film after molding can be reduced, which is preferable in terms of suppressing coating film peeling during heat treatment.

After drawing and ironing, doming molding of the bottom portion and trimming of the opening end edge are performed according to a common method as desired.

According to the disclosure, after the coated metal sheet is subjected to drawing and ironing, the obtained drawn/ironed can is subjected to a heat treatment process. As described above, in the coated metal sheet and the drawn/ironed can of the disclosure, the stress relaxation ratio of the coating film is 50% or higher in the can inner surface and higher than 40% in the can outer surface, which is high, and thus, peeling of the coating film is effectively prevented even when heated in the heat treatment process.

The residual stress in the coating film generated by the processing can be removed by subjecting the drawn/ironed can after molding to heat treatment at least in the single stage. By removing the residual stress in the coating film, it is possible to improve the adhesion between the coating film and the metal substrate (coating film adhesion) after the processing. As a result, the corrosion resistance of the coating film is significantly improved, so that occurrence of corrosion under the coating film can be suppressed, for example, when the drawn/ironed can is filled with a content having a strong corrosive property. The temperature of the heat treatment needs to be higher than the glass transition temperature of the coating film, and is in a temperature range of from 100 to 300° C., and preferably from 150 to 250° C. The period of time of the heat treatment is not particularly limited, but heating is performed for from 0.1 to 600 seconds, preferably from 1 to 300 seconds, and more preferably from 20 to 180 seconds.

In a case where the residual stress in the coating film of the drawn/ironed can is not removed by heat treatment, when the coating film of the central portion of the can trunk (central portion in the height direction) where a degree of processing is large is isolated from the metal substrate and heated, its dimension largely changes in a direction in which the residual stress is released (mainly in a can height direction), and thus, by measuring a dimension change amount of the isolated coating film due to heating (heat shrinkage rate), it is possible to provide a rough indication of whether the residual stress is removed by heat treatment. Desirably, the heat shrinkage rate (with load) represented by the following formula (5) in the inner coating film of the central portion of the can trunk isolated from the drawn/ironed can is 30% or less, preferably 20% or less, more preferably 15% or less, and further preferably 10% or less. Furthermore, desirably, the heat shrinkage rate (without load) represented by the following formula (6) is 50% or less, preferably 45% or less, more preferably 40% or less, and further preferably 35% or less. In a case where the heat shrinkage rate is within the range described above, the coating film adhesion is improved, so that excellent corrosion resistance can be exhibited. In a case where the heat shrinkage rate is larger than the range described above, the residual stress is not sufficiently removed, corrosion resistance may be reduced due to insufficient coating film adhesion, and the coating film may be peeled off when the can is subjected to an impact and get dented. In addition, in a case where the outer surface coating film is provided on the can outer surface side, the heat shrinkage rate is also desirably within the range described above in the outer surface coating film of the central portion of the can trunk.

Note that the amount of change in dimension (shrinkage amount) of the isolated coating film due to heating can be measured by a thermomechanical analyzer (TMA) or the like.

$$\text{Heat shrinkage rate (with load)}=(\Delta L_1/L_0)\times 100(\%) \quad (5)$$

In the formula, $L_0$ is an initial length (measurement portion) of the coating film isolated from the central portion of the can trunk in the height direction, and $\Delta L_1$ is the maximum shrinkage amount (maximum value of the shrinkage length) of the coating film of the portion corresponding to $L_0$ in the height direction when the temperature is raised from 30° C. to 200° C. at a temperature increase rate of 5° C./min while applying a load of $5.20\times10^5$ N/m$^2$ per unit area.

$$\text{Heat shrinkage rate (without load)}=(\Delta L_2/L_0)\times 100(\%) \quad (6)$$

where $L_0$ is the initial length of the coating film isolated from the central portion of the can trunk in the height direction, $\Delta L_2$ is the maximum shrinkage amount (maximum value of the shrinkage length) of the coating film of the portion corresponding to $L_0$ in the height direction when the temperature is raised from 30° C. to 200° C. at the temperature raising rate of 5° C./min in an unloaded state.

After heat treatment, after quenching or cooling, furthermore, as needed, a printed layer is formed in the can trunk portion in a printing and baking process by a known method, and a finishing varnish layer for protecting the printed layer is formed on the printed layer. As desired, single stage or multi-stage neck-in processing is performed, and flange processing is performed to form a can for seaming. Alternatively, after the drawn/ironed can is molded, the upper portion thereof can be deformed to form a bottle shape, or the bottom portion thereof can be cut out and another can end can be attached thereto to form a bottle shape.

Preferably, a capacity of the drawn/ironed can is from 150 mL or greater, preferably from 150 to 2200 mL, more preferably from 180 to 1200 mL, and further preferably from 300 to 700 mL.

The coated metal sheet according to the disclosure has excellent can forming processability, so that it is possible to withstand severe processing as in the production of the drawn/ironed can. In addition, coating film peeling does not occur even in heat treatment after molding, so that by adjusting molding conditions such as an ironing speed, it is possible to obtain the drawn/ironed can having an excellent covering property of the coating film in which the inner surface coating film has a degree of coverage of less than 200 mA in terms of an enamel rater value (ERV). Here, the degree of coverage of the inner surface coating film obtained in terms of ERV is a value obtained by filling the obtained drawn/ironed can with salt solution of a concentration of 1 mass %, which is an electrolytic solution, to the vicinity of the can opening and measuring ERV by an enamel rater, and is defined as a current value after connecting an anode electrode to a metal exposure portion formed on the outer surface side of the can bottom while immersing a cathode electrode in the salt solution filled in the can, and applying a direct voltage of 6.3 V for 4 seconds at room temperature (approximately 23° C.). In such a measurement, larger current flowing indicates that there is a defect in the inner surface coating film, which is an insulator, and that an area of metal exposure on the can inner surface is larger.

Desirably, the degree of coverage of the inner surface coating film in terms of ERV is less than 200 mA, preferably less than 100 mA, and more preferably less than 50 mA. In a case of expressing the degree of coverage in ERV per unit area (cm$^2$), desirably, it is less than 0.70 mA/cm$^2$, preferably less than 0.35 mA/cm$^2$, and more preferably less than 0.18 mA/cm$^2$. Here, the ERV per unit area is a value obtained by dividing the ERV of the drawn/ironed can measured by the method described above by an evaluation area (an area where the inner surface of the can trunk portion and the can bottom portion is in contact with the above-described salt solution).

Note that on the inner surface side of the drawn/ironed can, after molding, the inner surface may be further subjected to spray-coating to form another coating film on the inner surface coating film as necessary, but the inner surface coating film has a high degree of coverage even after molding, so that it is not necessary to perform spray-coating, and preferably, spray-coating is not performed from the perspective of economic efficiency.

On the other hand, on the can outer surface side, the outer surface coating film may be positioned on the surface layer at least on the bottom portion where the printed layer is not basically formed, but for the purpose of improving transportability of the can body or the like, a coating film made of another coating composition may be further formed on the outer surface coating film formed on the surface layer on the outer surface side of the bottom portion.

The coated metal sheet according to the disclosure can also be preferably applied to a use other than the drawn/ironed can, such as a drawn can (DR can), a deep-drawing can (DRD can), a DTR can, a stretched/drawn/ironed can, a can lid, or the like, by a known production method. As a shape of the can lid, a known shape such as an easy-open lid in which a score for forming an opening for pouring a content and a tab for opening are provided can be employed, and either a full open type or a partial open type (stay-on type) may be employed.

EXAMPLES

Hereinafter, the disclosure will be specifically described using Examples, Comparative Examples, and Reference Example. Note that simple "parts" indicate "parts by mass".

Various measurement items of polyester resins A to D were according to the following method. Note that all the polyester resins A to D are non-crystalline polyester resins.

Measurement of Number Average Molecular Weight

The number average molecular weight was measured by using a calibration curve of standard polystyrene with gel permeation chromatography (GPC).

Measurement of Glass Transition Temperature

The glass transition temperature was measured by using a differential scanning calorimeter (DSC) at a temperature raising rate of 10° C./min.

Measurement of Acid Value

One g of a solid product of a polyester resin was dissolved in 10 ml of chloroform and titrated with 0.1 N KOH ethanol solution to determine the acid value of the resin (mg KOH/g). As an indicator, phenolphthalein was used.

Measurement of Monomer Composition

Thirty mg of a solid product of a polyester resin was dissolved in 0.6 mL of deuterated chloroform and 1H-NMR measurement was performed to determine a monomer composition ratio from peak intensities. A composition ratio was determined by removing components of small quantities (less than 1 mol % with respect to the total monomer components).

Example 1

Preparation of Coating Composition for Inner Surface

The polyester resin A (acid value: 2 mg KOH/g, Tg: 75° C., Mn=18000, monomer composition: terephthalic acid component/isophthalic acid component/ethylene glycol component/propylene glycol component=38/12/17/33 mol %) as the polyester resin, the resol-type phenolic resin as the curing agent, and dodecylbenzene sulfonic acid as the curing catalyst (acid catalyst) were used. Note that an m-cresol-based resol-type phenolic resin obtained by alkyl-etherifying methylol groups with n-butanol (proportion of alkyl-etherified methylol groups: 90 mol %, Mn=1,200) as the resol-type phenolic resin and "dodecylbenzene sulfonic acid (soft type) (mixture)" available from Tokyo Chemical Industry Co., Ltd. as the acid catalyst were used.

The polyester resin A was dissolved in a mixed solvent of methyl ethyl ketone/solvent naphtha=50/50 (mass ratio) to obtain a polyester resin A solution with a solid content of 30 mass %. An n-butanol solution of the resol-type phenolic resin (solid content of 50 mass %) was diluted with methyl ethyl ketone to obtain a resol-type phenolic resin solution with a solid content of 30 mass %. After the dodecylbenzenesulfonic acid was amine-neutralized with 2-dimethylaminoethanol, the resulting neutralized product was dissolved in isopropanol to obtain a dodecylbenzenesulfonic acid solution with a solid content of 30 mass %.

Next, 333 parts of the polyester resin A solution (solid content of 100 parts), 33.3 parts of the resol-type phenolic resin solution (solid content of 10 parts), and 0.33 parts of the acid catalyst solution (solid content of 0.10 parts) were placed in a glass container and stirred for 10 minutes to prepare a solvent-type coating composition [solid content concentration: approximately 30 mass %, solid content blending ratio: polyester resin A/resol-type phenolic resin/acid catalyst=100/10/0.1 (mass ratio)].

Preparation of Coating Composition for Outer Surface

The polyester resin A was used as the polyester resin, the melamine resin (methyl-etherified melamine resin, full-ether type, weight average polymerization degree: 1.3) and the benzoguanamine resin (methyl-etherified benzoguanamine resin, imino group/methylol group-containing partial etherification type, weight average polymerization degree of 1.5) were used as the curing agent, and the dodecylbenzene sulfonic acid was used as the curing catalyst (acid catalyst).

The polyester resin A was dissolved in a mixed solvent of methyl ethyl ketone/solvent naphtha=50/50 (mass ratio) to obtain a polyester resin A solution with a solid content of 30 mass %. The melamine resin and the benzoguanamine resin were dissolved in methyl ethyl ketone to obtain a melamine resin solution and a benzoguanamine resin solution with a solid content of 30 mass %. The dodecyl benzene sulfonic acid was amine-neutralized with 2-dimethylaminoethanol and then dissolved in isopropanol to obtain a dodecylbenzene sulfonic acid solution with a solid content of 30 mass %.

Next, 333 parts of the polyester resin A solution (solid content of 100 parts), 10 parts of a melamine resin B solution (solid content of 3 parts), 10 parts of the benzoguanamine resin solution (solid content of 3 parts), and 0.33 parts of the acid catalyst solution (solid content of 0.10 parts) were placed in a glass container and stirred for 10 minutes to prepare a solvent-type coating composition [solid content concentration: approximately 30 mass %, solid content blending ratio: polyester resin A/melamine resin/benzoguanamine resin/acid catalyst (dodecylbenzene sulfonic acid) =100/3/3/0.1 (mass ratio)].

Production of Coated Metal Sheet

A phosphoric acid chromate-based surface treated aluminum sheet (3104 alloy, sheet thickness: 0.27 mm, weight of chrome in the surface treating film: 20 mg/m$^2$) was used, a surface to be on the outer surface side after molding was first coated with the coating composition for outer surface by a bar coater in such a manner that a dry weight of the coating film after baking was 40 mg/dm$^2$ (approximately 3 μm), and drying was performed at 120° C. for 60 seconds. Thereafter, a surface to be on the inner surface side was coated with the coating composition for inner surface by a bar coater in such a manner that a dry weight of the coating film after baking was 88 mg/dm$^2$ (approximately 6.4 μm), drying was performed at 120° C. for 60 seconds, and then baking was performed at 250° C. (furnace internal temperature in the oven) for 30 seconds to produce the coated metal sheet.

Production of Drawn/Ironed Can

After a paraffin wax was applied to both sides of the coated metal sheet produced by the method described above, it was punched into a circle having a diameter of 142 mm to form a shallow drawn cup. Next, the shallow drawn cup was subjected to re-drawing, ironing (three stages), and doming using a punch with an outer diameter of Φ66 mm under a dry condition. Thereafter, an oven was used to perform heat treatment at 201° C. for 75 seconds to obtain the drawn/ironed can [can diameter: 66 mm, height: approximately 130 mm, capacity: approximately 370 ml, total drawn ratio: 2.15, ironed rate: 61%, thickness of central portion of can trunk/thickness of central portion of can bottom×100=approximately 40%, thickness of metal base material of central portion of can trunk/thickness of metal base material of central portion of can bottom×100=approximately 40%, thickness of inner surface coating film of central portion of can trunk/thickness of inner surface coating film of central portion of can bottom×100=approximately 39%, weight (film thickness) of inner surface coating film of central portion of can bottom: 86 mg/dm$^2$ (approximately 6.2 μm), thickness of inner coating film of central portion of can bottom/thickness of metal substrate of central portion of can bottom=approximately 0.024, thickness of inner surface coating film of central portion of can trunk/thickness of metal substrate of central portion of can trunk=approximately 0.023]. Note that an average processing speed during ironing (average moving speed of the punch during ironing) was set to 5500 mm/sec.

Examples 2 and 3

Coated metal sheets were produced in the same manner as in Example 1 except that the coating compositions for inner surface were prepared by changing types of the polyester resin and solid content ratios as shown in Table 1 to be used, and drawn/ironed cans were produced. Note that as the polyester resin, the polyester resin B (acid value: 2 mg KOH/g, Tg: 85° C., Mn=18000, monomer composition: terephthalic acid component/ethylene glycol component/propylene glycol component=50/14/36 mol %), and the polyester resin C (acid value: 5 mg KOH/g, Tg: 55° C., Mn=16000, monomer composition: terephthalic acid component/isophthalic acid component/1,4-cyclohexane dimethanol component/2-methyl-1,3-propanediol component=10/40/21/29 mol %) were used other than the polyester resin described above.

Example 4

As shown in Table 1, the polyester resin A and the polyester resin D (acid value: 22 mg KOH/g, Tg: 82° C., Mn=6000, monomer composition: terephthalic acid component/trimellitic acid component/ethylene glycol component/propylene glycol component=49/1/12/38 mol %) were mixed in a mass ratio of 90:10, and the resulting mixture ($Tg_{mix}$: 76° C., $AV_{mix}$: 4 mg KOH/g) was used as the polyester resin to prepare an inner surface coating composition. As shown in Table 1, a coated metal sheet was produced in the same manner as in Example 1 except that a benzoguanamine resin (methyl-etherified benzoguanamine resin, imino group/methylol group-containing partial etherification type, weight average polymerization degree: 1.5) was used as the curing agent and the solid content blending ratio was changed to prepare a coating composition for outer surface, and a drawn/ironed can was produced.

Example 5

As shown in Table 1, a coated metal sheet was produced in the same manner as in Example 1 except that a mixture obtained by mixing the polyester resin A and the polyester resin D in a mass ratio of 90:10 was used as the polyester resin, the benzoguanamine resin (methyl-etherified benzoguanamine resin, imino group and methylol group-containing type, weight average polymerization degree of 1.5) described above was used as the curing agent, and the solid content blending ratio was changed to prepare the coating composition for inner surface, and a drawn/ironed can was produced.

Example 6

A coated metal sheet was produced and a drawn/ironed can was produced in the same manner as in Example 1 except that the average processing speed during ironing (average moving speed of punch during ironing) at the time of producing the drawn/ironed can was set to 1000 mm/sec.

Comparative Examples 1 and 2

Coated metal sheets were produced in the same manner as in Example 1 except that types of the polyester resin and solid content blending ratios were changed as shown in Table 1 to prepare the coating compositions for inner surface and the coating compositions for outer surface, and drawn/ironed cans were produced.

Reference Example 1

A coated metal sheet was produced in the same manner as in Example 1 except that types of the polyester resin and solid content blending ratio were changed as shown in Table 1 to prepare the coating composition for inner surface.

For coating film characteristics obtained in the coating compositions for inner surface and the coating compositions for outer surface used in Examples, Comparative Examples, and Reference Example, tests were conducted in accordance with the following test methods.

Stress Relaxation Ratio of Coating Film

A coating film sample for measurement was prepared as described below using the coating composition for inner surface and the coating composition for outer surface used in each of Examples, Comparative Examples, and Reference Example. In order that coating conditions were the same as the coating conditions (coating material type, dry weight of coating film, drying and baking conditions) of the inner surface coating film in the coated metal sheet of each of Examples, Comparative Examples, and Reference Example, on a non-glossy surface side of aluminum foil ("nippaku foil" available from Mitsubishi Aluminum Co., Ltd., thickness of 12 μm), coating was performed by a bar coater, drying was performed at 120° C. for 60 seconds, and then baking was performed at 250° C. for 30 seconds to form a coating film on the aluminum foil. After cooling to room temperature, the aluminum foil on which the coating film was formed was cut out into 40 mm long with 50 mm wide, and immersed in diluted hydrochloric acid aqueous solution to dissolve the aluminum foil. Next, the film-shaped coating film was taken out, sufficiently washed with distilled water, and dried, and the resulting film-shaped coating film was cut out into 40 mm long with 4 mm wide to obtain a measurement sample.

The stress relaxation ratio was measured using a thermomechanical analyzer (TMA) for the obtained measurement sample. After the sample was first chucked with no deflection in the thermomechanical analyzer, the stress relaxation ratio was measured by the thermomechanical analyzer (TMA) for the obtained measurement sample. First, the sample was chucked with no deflection in the thermomechanical analyzer, and an inter-chuck distance (corresponding to the initial length of the sample) was set to 10 mm. Then, the measurement atmosphere temperature was raised, and after 10 minutes after 100° C. was reached, the sample was elongated by 1% of the initial length of the sample at a tensile rate of 1 mm/min, and held in the state for 10 minutes. The stress relaxation ratio was calculated from a stress (Δ1) at 1% elongation and a stress (Δ2) after 10-minute holding by the following formula (1). Measurement conditions are as follows:

Instrument: TMA/SS6100, available from Seiko Instruments Inc.

Measurement atmosphere temperature: 100° C.

Inter-chuck distance: 10 mm

Tensile rate: 1 mm/min

Elongation rate (tensile elongation strain): 1%

$$\text{Stress relaxation ratio (\%)}=(\Delta 1-\Delta 2)/\Delta 1\times 100 \quad (1)$$

where Δ1 is the stress at 1% elongation, and Δ2 is the stress after 10-minute holding. Note that a numerical value of each of Δ1 and Δ2 is a correction value obtained by subtracting a numerical value of a stress immediately before 1% elongation after reaching 100° C. from the actual measurement value.

Note that in a case where the measurement sample is obtained from the coated metal sheet in which the coating film is formed on both sides, the coated metal sheet is cut out, immersed in boiled hydrogen peroxide water for several minutes, and sufficiently washed with distilled water, and then the film-shaped coating film is peeled off from the metal base material and dried, and the resulting film is cut out into 40 mm long with 4 mm wide, so that the measurement sample can be obtained.

Stress Relaxation Ratio of Inner Surface Coating Film of Can Bottom

For the drawn/ironed cans of Example 4 and Comparative Example 1 that were molded as described in the above "Production of drawn/ironed can" and subjected to heat treatment at 201° C. for 75 seconds, the stress relaxation ratio of the inner surface coating film of the can bottom was measured. The method for preparing the measurement sample is as follows.

The can bottom portion was cut out from the can bottom of the drawn/ironed can after the heat treatment to have a dimension of 35 mm in a direction of 0° and 30 mm in a direction of 90° with respect to the metal substrate rolling direction, about the central portion of the can bottom. After the cut-out sample was immersed in boiled hydrogen peroxide water for 2 to 3 minutes and sufficiently washed with distilled water, the film-shaped coating film on the can inner surface side was peeled off from the metal base metal and dried, and the resulting film-shaped coating film was cut out into 35 mm long with 4 mm wide to obtain the measurement sample.

The stress relaxation ratio was measured in the same manner as the measurement method described in the above "Stress relaxation ratio of coating film". Results are shown below.

Stress relaxation ratio of inner surface coating film of can bottom of drawn/ironed can of Example 4: 67%

Stress relaxation ratio of inner surface coating film of can bottom of drawn/ironed can of Comparative Example 1: 45%

Glass Transition Temperature of Coating Film (Coating Film Tg)

A coating film sample for measurement was prepared as described below using the coating composition for inner surface and the coating composition for outer surface used in each of Examples, Comparative Examples, and Reference Example. In order that coating conditions are the same as the coating conditions (coating material type, dry weight of coating film, drying and baking conditions) of the inner or outer surface coating film in the coated metal sheet of each of Examples, Comparative Examples, and Reference Example, on a non-glossy surface side of aluminum foil ("nippaku foil" available from Mitsubishi Aluminum Co., Ltd., thickness of 12 μm), coating was performed by a bar coater, drying was performed at 120° C. for 60 seconds, and then baking was performed at 250° C. for 30 seconds to form a coating film on the aluminum foil. After cooling to room temperature, the aluminum foil on which the coating film was formed was immersed in diluted hydrochloric acid aqueous solution to dissolve the aluminum foil. The film-shaped coating film was then taken out, sufficiently washed with distilled water, and dried to obtain the measurement sample. For the obtained coating film, the glass transition temperature of the coating film was measured using a differential scanning calorimeter (DSC) in the following conditions. Note that in 2nd-run (temperature raising), the temperature at the intersection of a straight line drawn by extending an extrapolated glass transition onset temperature, that is, baseline on the lower temperature side toward the high temperature side and a tangent line drawn at a point where a slope of a curve of a stepwise changing portion of glass transition was the maximum was defined as the glass transition temperature of the coating film (coating film Tg).

Instrument: DSC6220, available from Seiko Instruments Inc.

Sample amount: 5 mg

Temperature raising rate: 10° C./min

Temperature range: from −80 to 200° C. (heating, cooling, heating)

Environmental condition: under nitrogen gas flow

Note that in a case where the measurement sample is obtained from the coated metal sheet or drawn/ironed can in which the coating film is formed on both sides, the coating film on one side that is not measured is removed by scraping with sandpaper or the like to expose a metal surface, and then the coated metal sheet is cut out, the metal substrate (metal sheet) is dissolved by a common method such as immersion in diluted hydrochloric acid aqueous solution to take out the film-shaped coating film, and the resulting coating film is sufficiently washed with distilled water and dried, so that the measurement sample can be obtained.

MEK Extraction Rate

A coating film sample for measurement was prepared as described below using the coating composition for inner surface and the coating composition for outer surface used in each of Examples, Comparative Examples, and Reference Example. In order that coating conditions are the same as the coating conditions (coating material type, dry weight of coating film, drying and baking conditions) of the inner or outer surface coating film in the coated metal sheet of each of Examples, Comparative Examples, and Reference Example, on each phosphoric acid chromate-based surface-treated aluminum sheet (3104 alloy, sheet thickness: 0.27 mm, chrome weight in the surface-treated film: 20 mg/m$^2$), coating was performed by a bar coater, drying was performed at 120° C. for 60 seconds, and baking was then performed at 250° C. for 30 seconds to form the coated metal sheet. A test piece of 5 cm×5 cm size was cut out from the coated metal sheet, and after measuring the mass of the test piece (W1), using 200 ml of methyl ethyl ketone (MEK), the test piece was immersed in MEK boiling (under reflux at 80° C.) for 1 hour to perform MEK extraction at the boiling point for 1 hour. After the test piece after extraction was washed with MEK, it is dried at 120° C. for 1 hour, and the mass of the test piece after extraction (W2) was measured. Furthermore, the coating film was peeled off and removed by a decomposition method with concentrated sulfuric acid, washing and drying were performed, and the mass of the test piece (W3) was measured. The MEK extraction rate (mass %) of the coating film of the coated metal sheet is determined by the following formula (7). The results are shown in Table 1.

$$\text{MEK extraction rate (\%)}=100\times(W1-W2)/(W1-W3) \quad (7)$$

Note that in a case where the measurement sample is obtained from the coated metal sheet or the drawn/ironed can in which the coating film is formed on both sides, the coating film on one side that is not measured is removed by scraping with sandpaper or the like, and then the MEK extraction rate of the coating film of the coated metal sheet can be measured by the method described above.

In the drawn/ironed can and coated metal sheets obtained in each of Examples, Comparative Examples, and Reference Example, evaluation was performed in accordance with the following test methods.

Evaluation of Covering Property of Inner Surface Coating Film (ERV Evaluation)

Evaluation of covering property of the inner surface coating film was performed as described below, for the drawn/ironed can subjected to drawing/ironing and doming as described in the above "Production of drawn/ironed can" (indicated as "without heat treatment" in the table), and the drawn/ironed can further subjected to heat treatment at 201° C. for 75 seconds in an oven (indicated as "with heat treatment" in the table).

A metal exposed portion was formed on the outer surface side of the can bottom of the drawn/ironed can, the can body was connected to the anode electrode of an enamel rater, while 360 mL of 1% salt solution was poured into the can and the cathode electrode of the enamel rater was immersed in the salt solution filled in the can, whereby a current value (ERV) after applying a voltage of 6.3 V for 4 seconds at room temperature was measured.

Evaluation criteria are as follows:

Excellent: Current value of less than 50 mA (less than 0.18 mA/cm$^2$ per unit area)

Good: Current value of 50 mA or greater and less than 200 mA (0.18 mA/cm$^2$ or greater and less than 0.70 mA/cm$^2$)

Marginal: Current value of 200 mA or greater and less than 700 mA (0.70 mA/cm$^2$ or greater and less than 2.50 mA/cm$^2$)

Poor: Current value of 700 mA or greater (2.50 mA/cm$^2$ or greater)

Evaluation of Coating Film Peeling Resistance

Evaluation of the coating film peeling resistance was performed by observing presence or absence of peeling of the inner and outer surface coating films in the can trunk portion, for the drawn/ironed can after molded as described in the above "Production of drawn/ironed can" and subjected to heat treatment at 201° C. for 75 seconds.

Evaluation criteria are as follows:

Good: No coating film peeling is observed.

Marginal: Slight coating peeling is observed at a site that is thinned by severe processing in can trunk side wall.

Poor: Coating peeling is observed in a wide range of the site that is thinned by severe processing in can trunk side wall.

Base Material Adhesion Evaluation

A test piece having a strip shape of 50 mm high and 15 mm wide was cut out from the coated metal sheet produced as described above. A flaw reaching the base metal was made into a surface to be on the can outer surface side of the coated metal sheet at a position of 35 mm from the tip of the strip shape. After cutting only the metal substrate by repeating bending and stretching at the pre-formed flaw as an starting point to make a portion where connection was made only by the inner surface coating film, and then, bending was performed in such a manner that the portion was on the inner side, and a 180° peel (peeling) test was performed using a tensile tester ("Autograph AG-IS" available from Shimadzu Corporation) at 23° C. and the tensile rate of 5 mm/min to measure the peeling strength (180° peel strength).

An evaluation portion where the inner surface coating film was peeled off from the metal substrate was visually observed, and in a case where the inner surface coating film of the evaluation portion was peeled off from the metal substrate as a whole, it was evaluated that interfacial peeling occurred in the coating film, and in a case where adhesion between the coating film and the metal substrate was strong and the inner surface coating film broke down before the coating film was peeled off from the metal substrate, it was evaluated that cohesive failure occurred in the coating film.

Evaluation criteria are as follows.

Excellent: Peeling strength of 2.0 N/15 mm or greater in interfacial peeling or cohesive failure Good: Peeling strength of less than 2.0 N/15 mm and 1.0 N/15 mm or greater in interfacial peeling Marginal: Peeling strength of less than 1.0 N/15 mm in interfacial peeling

Heat Shrinkage Rate Evaluation

Evaluation of the heat shrinkage rate was performed as described below using the inner surface coating film of the central portion of the can trunk of the drawn/ironed can of Example 4 subjected to drawing and ironing and doming as described in the above "Production of drawn/ironed can" (without heat treatment) and the drawn/ironed can of Example 4 further subjected to heat treatment at 201° C. for 75 seconds in an oven (with heat treatment).

The above drawn/ironed can was used to cut out a sample of 10 mm in the can trunk circumferential direction and 20 mm in the can height direction around the central portion of the can trunk (thinnest portion) in a direction of 0° with respect to the metal substrate rolling direction. The coating film on the can outer surface side was removed by scraping with sandpaper or the like to exposure the metal surface, and then immersed in the diluted hydrochloric acid aqueous solution to dissolve the metal substrate. Next, the coating film on the can inner surface side having a film shape was taken out, sufficiently washed with distilled water, and dried, and the resulting film-shaped coating film was cut out into 20 mm long (can height direction) with 4 mm wide (can trunk circumferential direction) to obtain the measurement sample.

The measurement sample was chucked in a thermomechanical analyzer, and the inter-chuck distance (corresponding to the initial length of the measurement portion in the height direction of the coating film) was set to 5 mm. The displacement amount of the measurement sample was measured under the following conditions, and the heat shrinkage rate in the can height direction was evaluated in a loaded state and an unloaded state:

Instrument: TMA/SS6100, available from Seiko Instruments Inc.

Temperature raising rate: 5° C./min

Temperature range: from 30° C. to 200° C.

Measurement mode: tensile mode

Load in measurement: 5 mN ($5.20\times10^5$ N/m$^2$) or no load

Inter-chuck distance: 5 mm

The inter-chuck distance before measurement (corresponding to the initial length of the measurement portion of the coating film) was defined as $L_0$, the maximum value of the shrinkage amount (maximum shrinkage length) in the height direction of a portion corresponding to $L_0$ when temperature was raised from 30° C. to 200° C. at the temperature raising rate of 5° C./min while applying a load of $5.20\times10^5$ N/m$^2$ per unit area was defined as $\Delta L_1$, and a value calculated by the mathematical formula represented by the following formula (5) was defined as the heat shrinkage rate (with load). Note that for the displacement amount, shrinkage was defined as a positive value, and expansion or elongation was defined as a negative value. The results are shown below.

$$\text{Heat Shrinkage rate (with load)}=(\Delta L_1/L_0)\times100(\%) \quad (5)$$

Heat Shrinkage rate of inner surface coating film of drawn/ironed can of Example 4 (without heat treatment): 68%

Heat Shrinkage rate of inner surface coating film of drawn/ironed can of Example 4 (with heat treatment): 8%

In addition, the inter-chuck distance before measurement (corresponding to the initial length of the measurement portion of the coating film) was defined as $L_0$, the maximum value of the shrinkage amount (maximum length) in the height direction of a portion corresponding to $L_0$ when raising temperature from 30° C. to 200° C. at the temperature raising rate of 5° C./min was defined as $\Delta L_2$, and a value calculated by the mathematical formula represented by the following formula (6) was defined as the heat shrinkage rate (without load). Note that for the displacement amount, shrinkage was defined as a positive value, and expansion or elongation was defined as a negative value. The results are shown below.

$$\text{Heat shrinkage rate (without load)}=(\Delta L_2/L_0)\times100(\%) \quad (6)$$

Heat shrinkage rate of inner surface coating film of drawn/ironed can of Example 4 (without heat treatment) (without load): 69%

Heat shrinkage rate of inner surface coating film of drawn/ironed can of Example 4 (with heat treatment) (without load): 30%

Corrosion Resistance Evaluation

Evaluation of the corrosion resistance was performed as described below using the inner surface coating film of the central portion of the can trunk of the drawn/ironed can of Example 4 subjected to drawing and ironing and doming as described in the above "Production of drawn/ironed can" (without heat treatment) and the drawn/ironed can of Example 4 further subjected to heat treatment at 201° C. for 75 seconds in an oven (with heat treatment).

The above drawn/ironed can was used to cut out a test piece of 40 mm in the can trunk circumferential direction and 40 mm in the can height direction around the central portion of the can trunk (thinnest portion). A cross-cut flaw having a length of 4 cm and reaching the base metal was made into the test piece using a cutter, the test piece was immersed in an acidic model liquid containing salt, and after 2 weeks elapsed at 37° C., the corrosion state was evaluated. The model liquid used in the test was prepared in such a manner that salt was 0.2% and citric acid was added thereto to adjust pH to 2.5. For the evaluation criteria, around the cross-cut portion, a test piece having a maximum width of corrosion under the coating film of 1.5 mm or greater was rated Poor, a test piece having a maximum width of corrosion of 0.5 mm or greater and less than 1.5 mm was rated Good, and a test piece having a maximum width of corrosion of less than 0.5 mm was rated Excellent. The results are shown below.

Corrosion state of drawn/ironed can of Example 4 (without heat treatment): Poor

Corrosion state of drawn/ironed can of Example 4 (with heat treatment): Excellent Table 1 shows blending compositions of the inner surface coating composition and the outer surface coating composition (types of polyester resin, types of curing agent, solid content blending ratios), the coating film performance of the inner surface coating film and the outer surface coating film (coating film Tg, MEK extraction rate, stress relaxation ratio), and evaluation results of each of Examples, Comparative Examples, and Reference Example.

TABLE 1-1

| | Polyester resin | Types | Tg (° C.) | Acid value (mg KOH/g) | Mn | Examples 1 | 2 | 3 | 4 | 5 | 6 |
|---|---|---|---|---|---|---|---|---|---|---|---|
| Composition of coating composition for inner surface | | A | 75 | 2 | 18000 | 100 | | | 90 | 90 | 100 |
| | | B | 85 | 2 | 18000 | | 100 | | | | |
| | | C | 55 | 5 | 16000 | | | 100 | | | |
| | | D | 82 | 22 | 8000 | | | | 10 | 10 | |
| | Curing agent | | Resol-type phenolic resin | | | 10 | 10 | 5 | 10 | | 10 |
| | | | Benzoguanamine resin | | | | | | | 15 | |
| | | | Melamine resin | | | | | | | | |
| | Acid catalyst | | Dodecylbenzenesulfonic acid | | | 0.1 | 0.1 | 0.1 | 0.1 | 0.1 | 0.1 |
| Inner surface coating film characteristics | | | Coating film Tg | | | 74 | 86 | 56 | 80 | 82 | 74 |
| | | | MEK extraction rate | | | 6 | 7 | 18 | 9 | 11 | 6 |
| | | | Stress relaxation ratio | | | 65 | 70 | 54 | 66 | 68 | 65 |

| | Polyester resin | Types | Tg (° C.) | Acid value (mgKOH/g) | Mn | | | | | | |
|---|---|---|---|---|---|---|---|---|---|---|---|
| Composition of coating composition for | | A | 75 | 2 | 18000 | 100 | 100 | 100 | 100 | 100 | 100 |
| | Curing agent | | Melamine resin | | | 3 | 3 | 3 | | 3 | 3 |
| | | | Benzoguanamine resin | | | 3 | 3 | 3 | 15 | 3 | 3 |

TABLE 1-1-continued

| | | | | | | | | |
|---|---|---|---|---|---|---|---|---|
| outer surface | Acid catalyst | Dodecylbenzenesulfonic acid | 0.1 | 0.1 | 0.1 | 0.1 | 0.1 | 0.1 |
| Outer surface coating film characteristics | | Coating film Tg | 82 | 82 | 82 | 82 | 82 | 82 |
| | | MEK extraction rate | 13 | 13 | 13 | 14 | 13 | 13 |
| | | Stress relaxation ratio | 57 | 57 | 57 | 72 | 57 | 57 |
| Evaluation | Covering property of inner surface coating film | Without heat treatment | Excellent | Excellent | Excellent | Excellent | Good | Marginal |
| | | With heat treatment | Excellent | Excellent | Excellent | Excellent | Good | — |
| | Coating film peeling resistance | Can inner surface | Good | Good | Good | Good | Good | Marginal |
| | | Can outer surface | Good | Good | Good | Good | Good | Marginal |
| | | Substrate adhesion | Good | Good | — | Excellent | Excellent | Good |

TABLE 1-2

| | Polyester resin | Types | Tg (° C.) | Acid value (mg KOH/g) | Mn | Comparative Examples 1 | Comparative Examples 2 | Reference Example 1 |
|---|---|---|---|---|---|---|---|---|
| Composition of coating composition for inner surface | | A | 75 | 2 | 18000 | | 100 | 90 |
| | | B | 85 | 2 | 18000 | | | |
| | | C | 55 | 5 | 16000 | 100 | | |
| | | D | 82 | 22 | 8000 | | | 10 |
| | Curing agent | Resol-type phenolic resin | | | | 10 | | 10 |
| | | Benzoguanamine resin | | | | | | |
| | | Melamine resin | | | | | 5.5 | |
| | Acid catalyst | Dodecylbenzenesulfonic acid | | | | 0.1 | 0.1 | 0.5 |
| Inner surface coating film characteristics | | Coating film Tg | | | | 55 | 81 | — |
| | | MEK extraction rate | | | | 3 | 6 | — |
| | | Stress relaxation ratio | | | | 38 | 48 | — |
| | Polyester resin | Types | Tg (° C.) | Acid value (mg KOH/g) | Mn | | | |
| Composition of coating composition for outer surface | | A | 75 | 2 | 18000 | 100 | 100 | 100 |
| | Curing agent | Melamine resin | | | | 3 | 5.5 | 3 |
| | | Benzoguanamine resin | | | | 3 | | 3 |
| | Acid catalyst | Dodecylbenzenesulfonic acid | | | | 0.1 | 0.1 | 0.1 |
| Outer surface coating film characteristics | | Coating film Tg | | | | 82 | 81 | 82 |
| | | MEK extraction rate | | | | 13 | 6 | 13 |
| | | Stress relaxation ratio | | | | 57 | 40 | 57 |
| Evaluation | Covering property of inner surface coating film | Without heat treatment | | | | Excellent | Good | — |
| | | With heat treatment | | | | Poor | Poor | — |
| | Coating film peeling resistance | Can inner surface | | | | Poor | Poor | — |
| | | Can outer surface | | | | Good | Poor | — |
| | | Substrate adhesion | | | | — | — | Marginal |

Not evaluated

The drawn/ironed can according to the disclosure has no coating film peeling during heat treatment to effectively prevent metal exposure, and has thus excellent corrosion resistance, so that it is possible to preferably use the drawn/ironed can as a beverage container or the like. In addition, the coated metal sheet for the drawn/ironed can according to the disclosure has excellent can forming processability and productivity, and has excellent coating film peeling resistance that coating film peeling does not occur even during heat treatment after molding, so that it is possible to preferably use the coated metal sheet in producing the drawn/ironed can.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

The invention claimed is:

1. A drawn/ironed can comprising at least an inner surface coating film on a can inner surface side, the inner surface coating film comprising a polyester resin and a curing agent, wherein a stress relaxation ratio of the inner surface coating film after 10 minutes at 1% elongation in a can bottom portion is 50% or higher;

wherein, when a total amount of polyhydric alcohol components constituting the polyester resin is 100 mol %, the polyester resin contained in the inner surface coating film comprises one, or two or more selected from ethylene glycol, propylene glycol, 1,4-butanediol, 2-methyl-1,3-propanediol, and diethylene glycol in an amount of 20 mol % or greater in total, wherein the stress relaxation ratio is measured as follows:

a sample for measurement is prepared by removing the inner surface coating film from the can bottom portion and then cutting the inner surface coating film into 40 mm long with 4 mm wide to obtain the sample, using a thermomechanical analyzer for the sample, after the sample was chucked with no deflection in the thermomechanical analyzer, an inter-chuck distance corresponding to the initial length of the sample was set to 10 mm; then, a measurement atmosphere temperature was raised, and 10 minutes after 100° C. was reached, the sample was elongated by 1% of the initial length of the sample at a tensile rate of 1 mm/min, and held in the state for 10 minutes; and then the stress relaxation ratio was calculated from a stress (Δ1) at 1% elongation and a stress (Δ2) after the 10-minute holding by the following formula (1) under the following Measurement conditions:

Instrument: thermomechanical analyzer TMA/SS6100, available from Seiko Instruments Inc.

Measurement atmosphere temperature: 100° C.

Inter-chuck distance: 10 mm

Tensile rate: 1 mm/min

Elongation rate (tensile elongation strain): 1%

$$\text{Stress relaxation ratio (\%)}=(\Delta 1-\Delta 2)/\Delta 1\times 100 \quad (1),$$

wherein, in formula (1), Δ1 is a stress at 1% elongation, and →2 is a stress after 10-minute holding, and a numerical value of each of Δ1 and Δ2 is a correction value obtained by subtracting a numerical value of a stress immediately before 1% elongation after reaching 100° C. from an actual measurement value.

2. The drawn/ironed can according to claim 1, further comprising an outer surface coating film on a can outer surface side, the outer surface coating film comprising a polyester resin and a curing agent, wherein a stress relaxation ratio of the outer surface coating film after 10 minutes at 1% elongation in a can bottom portion is higher than 40% under a test condition of 100° C.

3. The drawn/ironed can according to claim 1, wherein a thickness of a central portion of a can trunk is 20 to 75% of a thickness of a central portion of a can bottom.

4. The drawn/ironed can according to claim 1, wherein a thickness of the inner surface coating film in the central portion of the can trunk is 20 to 75% of a thickness of the inner surface coating film in the central portion of the can bottom.

5. The drawn/ironed can according to claim 1, wherein a thickness ratio of the inner surface coating film to a metal substrate (thickness of the inner surface coating film/thickness of the metal substrate) is substantially identical in a can bottom portion and a can trunk portion.

6. The drawn/ironed can according to claim 1, wherein a heat shrinkage rate of the inner surface coating film in the central portion of the can trunk represented by the following formula is 30% or less:

$$\text{Heat shrinkage rate (\%)}=(\Delta L_1/L_0)\times 100$$

$L_0$: initial length of the coating film isolated from the central portion of the can trunk in a height direction $\Delta L_1$: maximum shrinkage length in the height direction of a portion corresponding to $L_0$ when temperature is raised from 30° C. to 200° C. at a temperature raising rate of 5° C./min while applying a load of $5.20\times 10^5$ $N/m^2$ per unit area.

7. The drawn/ironed can according to claim 1, wherein a covering degree of the inner surface coating film is less than 200 mA in terms of ERV, wherein the covering degree in terms of ERV is measured as follows:

a metal exposed portion is formed on an outer surface side of the can bottom of the drawn/ironed can, the can body is connected to an anode electrode of an enamel rater, while 360 mL of 1% salt solution is poured into the can and the cathode electrode of the enamel rater is immersed in the salt solution filled in the can, whereby a current value (ERV) after applying a voltage of 6.3 V for 4 seconds at room temperature is measured.

8. The drawn/ironed can according to claim 1, wherein a MEK extraction rate of the inner surface coating film is in a range of from 2 to 30%.

9. The drawn/ironed can according to claim 1, wherein the curing agent contained in the inner surface coating film comprises a resol phenolic resin and/or an amino resin.

10. The drawn/ironed can according to claim 9, wherein the resol phenolic resin comprises an m-cresol-based resol-type phenolic resin.

11. The drawn/ironed can according to claim 1, wherein the inner surface coating film further comprises an acid catalyst.

12. The drawn/ironed can according to claim 11, wherein a content of the acid catalyst in the inner surface coating film is less than 0.5 parts by mass per 100 parts by mass of the polyester resin.

13. A coated metal sheet for a drawn/ironed can comprising a coating film on both surfaces, wherein an inner surface coating film of a surface to be on a can inner surface side after drawing and ironing contains a polyester resin and a resol phenolic resin and/or an amino resin as a curing agent, an outer surface coating film of a surface to be on a can outer surface side after drawing and ironing contains a polyester resin and an amino resin as the curing agent, and wherein a stress relaxation ratio of the inner surface coating film after 10 minutes at 1% elongation is 50% or higher, and a stress relaxation ratio of the outer surface coating film after 10 minutes at 1% elongation is higher than 40% under a test condition of 100° C.;

wherein when a total amount of polyhydric alcohol components constituting the polyester resin is 100 mol %, the polyester resin contained in the inner surface coating film contains one, or two or more selected from ethylene glycol, propylene glycol, 1,4-butanediol, 2-methyl-1,3-propanediol, and diethylene glycol in an amount of 20 mol % or greater in total, wherein the stress relaxation ratio is measured as follows:

a sample for measurement is prepared by removing the inner surface coating film from the can bottom portion and then cutting the inner surface coating film into 40 mm long with 4 mm wide to obtain the sample, using a thermomechanical analyzer for the sample, after the sample was chucked with no deflection in the thermomechanical analyzer, an inter-chuck distance corresponding to the initial length of the sample was set to 10 mm; then, a measurement atmosphere temperature was raised, and 10 minutes after 100° C. was reached, the sample was elongated by 1% of the initial length of the sample at a tensile rate of 1 mm/min, and held in the state for 10 minutes; and then the stress relaxation ratio was calculated from a stress (Δ1) at 1% elongation and a stress (Δ2) after the 10-minute holding by the following formula (1) under the following Measurement conditions:

Instrument: thermomechanical analyzer TMA/SS6100, available from Seiko Instruments Inc.
Measurement atmosphere temperature: 100° C.
Inter-chuck distance: 10 mm
Tensile rate: 1 mm/min
Elongation rate (tensile elongation strain): 1%

$$\text{Stress relaxation ratio (\%)}=(\Delta 1-\Delta 2)/\Delta 1\times 100 \quad (1),$$

wherein, in formula (1), Δ1 is a stress at 1% elongation, and Δ2 is a stress after 10-minute holding, and a numerical value of each of Δ1 and Δ2 is a correction value obtained by subtracting a numerical value of a stress immediately before 1% elongation after reaching 100° C. from an actual measurement value.

14. A drawn/ironed can comprising the coated metal sheet for a drawn/ironed can described in claim 13.

15. The drawn/ironed can according to claim 14, wherein a thickness of a central portion of a can trunk is 20 to 75% of a thickness of a central portion of a can bottom.

16. The drawn/ironed can according to claim 14, wherein a thickness of the inner surface coating film in the central portion of the can trunk is 20 to 75% of a thickness of the inner surface coating film in the central portion of the can bottom.

17. The drawn/ironed can according to claim 14, wherein a covering degree of the inner surface coating film is less than 200 mA in terms of ERV, wherein the covering degree in terms of ERV is measured as follows:

a metal exposed portion is formed on an outer surface side of the can bottom of the drawn/ironed can, the can body is connected to an anode electrode of an enamel rater, while 360 mL of 1% salt solution is poured into the can and the cathode electrode of the enamel rater is immersed in the salt solution filled in the can, whereby a current value (ERV) after applying a voltage of 6.3 V for 4 seconds at room temperature is measured.

* * * * *